US007864121B2

(12) United States Patent
Suprunov et al.

(10) Patent No.: US 7,864,121 B2
(45) Date of Patent: Jan. 4, 2011

(54) MIMO SELF-EXPANDABLE ANTENNA STRUCTURE

(75) Inventors: Peter Suprunov, East Brunswick, NJ (US); Victor Abramsky, Edison, NJ (US)

(73) Assignee: QUALCOMM Incorporated, San Diego, CA (US)

( * ) Notice: Subject to any disclaimer, the term of this patent is extended or adjusted under 35 U.S.C. 154(b) by 587 days.

(21) Appl. No.: 11/774,504

(22) Filed: Jul. 6, 2007

(65) Prior Publication Data

US 2009/0009421 A1 Jan. 8, 2009

(51) Int. Cl.
*H01Q 1/24* (2006.01)

(52) U.S. Cl. ..... 343/702; 343/881

(58) Field of Classification Search ..... 343/702, 343/880, 881

See application file for complete search history.

(56) References Cited

U.S. PATENT DOCUMENTS 3,521,290 A * 7/1970 Hossein et al. ..... 343/915
4,947,825 A * 8/1990 Moriarty ..... 126/685
6,833,817 B2 12/2004 Olsen
7,076,263 B2 7/2006 Medvedev et al.
2004/0113850 A1* 6/2004 Olsen ..... 343/702

FOREIGN PATENT DOCUMENTS

JP 60223208 11/1985
WO 03017420 2/2003

OTHER PUBLICATIONS

Partial International Search Report-PCT/US2008/068608, International Searching Authority-European Patent Office-Oct. 16, 2008.
International Search Report—PCT/US08068608, International Search Authority—European Patent Office—Feb. 19, 2009.
Written Opinion—PCT/US08/068608, International Search Authority—European Patent Office—Feb. 19, 2009.

* cited by examiner

*Primary Examiner*—Tho G Phan
(74) *Attorney, Agent, or Firm*—Jiayu Xu

(57) ABSTRACT

Systems and methodologies are described that provide a low cost, compact and easily manufacturable multiple-input, multiple-output antenna structure suitable for portable radio equipment. Multiple antenna elements are printed on a folded flexible material. The flexible material expands when the antenna structure is deployed for operation and collapses when stowed.

46 Claims, 21 Drawing Sheets

MIMO SELF-EXPANDABLE ANTENNA STRUCTURE

BACKGROUND

Wireless communication systems are widely deployed to provide various types of communication; for instance, voice and/or data may be provided via such wireless communication systems. A typical wireless communication system, or network, can provide multiple users access to one or more shared resources (e.g., bandwidth, transmit power, . . . ). For instance, a system may use a variety of multiple access techniques such as Frequency Division Multiplexing (FDM), Time Division Multiplexing (TDM), Code Division Multiplexing (CDM), Orthogonal Frequency Division Multiplexing (OFDM), and others.

Generally, wireless multiple access communication systems may simultaneously support communication for multiple mobile devices. Each mobile device may communicate with one or more base stations via transmissions on forward and reverse links. The forward link (or downlink) refers to the communication link from base stations to mobile devices, and the reverse link (or uplink) refers to the communication link from mobile devices to base stations. Further, communications between mobile devices and base stations may be established via single-input single-output (SISO) systems, multiple-input single-output (MISO) systems, multiple-input multiple-output (MIMO) systems, and so forth.

Mobile devices that utilize a single antenna for transmission and reception commonly operate with limited data transmission rates. In order to yield higher data transmission rates (e.g., multi-megabit speeds), wireless communication systems may implement MIMO systems. MIMO systems, in combination with space-time coding and other such data processing techniques, can achieve data transmission throughput several times greater than single antenna radio systems.

MIMO systems commonly employ multiple transmit antennas and multiple receive antennas for data transmission. A MIMO channel formed by the multiple transmit and receive antennas may be decomposed into a plurality of independent channels, which may be referred to as spatial channels. Each of the independent channels corresponds to a dimension. Moreover, MIMO systems may provide improved performance (e.g., increased spectral efficiency, higher throughput and/or greater reliability) if the additional dimensionalities created by the multiple transmit and received antennas are utilized.

Mobile devices, however, oftentimes have physical constraints (e.g., limited volume, size, . . . ) that can impact implementation of multiple antennas therewith. For instance, performance of conventional mobile devices commonly has suffered in comparison to single antenna performance due to such physical limitations. Accordingly, arranging multiple antennas that support operation in multiple frequency bands in a small form factor device can be difficult to achieve at low cost and in an aesthetically pleasing manner.

SUMMARY

The following presents a simplified summary of one or more embodiments in order to provide a basic understanding of such embodiments. This summary is not an extensive overview of all contemplated embodiments, and is intended to neither identify key or critical elements of all embodiments nor delineate the scope of any or all embodiments. Its sole purpose is to present some concepts of one or more embodiments in a simplified form as a prelude to the more detailed description that is presented later.

In accordance with one or more embodiments and corresponding disclosure thereof, various aspects are described in connection with a self-expandable multiple-input, multiple-output (MIMO) antenna. A flexible circuit is folded accordion-style and collapsed for storage. Further, a plurality of antenna elements are printed on the flexible circuit. The flexible circuit unfolds and fans out when deployed for operation. The fanning out creates polarization diversity among the plurality of antenna elements to enable multiple receiving and transmitting streams to occur at the same or different radio frequencies.

According to related aspects, a multiple antenna structure is described herein. The multiple antenna structure can include a fanning flexible circuit operable in and in between a collapsed and expanded position. Further, the multiple antenna structure can comprise a plurality of antenna elements printed on one or more surfaces of the fanning flexible circuit.

Another aspect relates to a multiple antenna communication system. The multiple antenna communication system can include a movable or removable antenna housing; a circuit board; and a flex member foldable accordion style, a first end of the flex member attached to the movable antenna housing and a second end of the flex member attached to the circuit board.

Yet another aspect relates to a self-expandable antenna system that enables multiple-input, multiple-out communications. The self-expandable antenna system can include means for expanding an antenna structure including one or more antenna elements. Moreover, the self-expandable antenna system can comprise means for receiving signals via the one or more antenna elements.

Still another aspect relates to a system that enables monitoring signal strength in connection with an expandable antenna structure. The system can include means for evaluating a signal to noise ratio (SNR); means for determining whether the SNR is below a threshold; and means for generating a notification to deploy an expandable antenna structure when the SNR is below the threshold.

To the accomplishment of the foregoing and related ends, the one or more embodiments comprise the features hereinafter fully described and particularly pointed out in the claims. The following description and the annexed drawings set forth in detail certain illustrative aspects of the one or more embodiments. These aspects are indicative, however, of but a few of the various ways in which the principles of various embodiments may be employed and the described embodiments are intended to include all such aspects and their equivalents.

DETAILED DESCRIPTION

Figure 1:
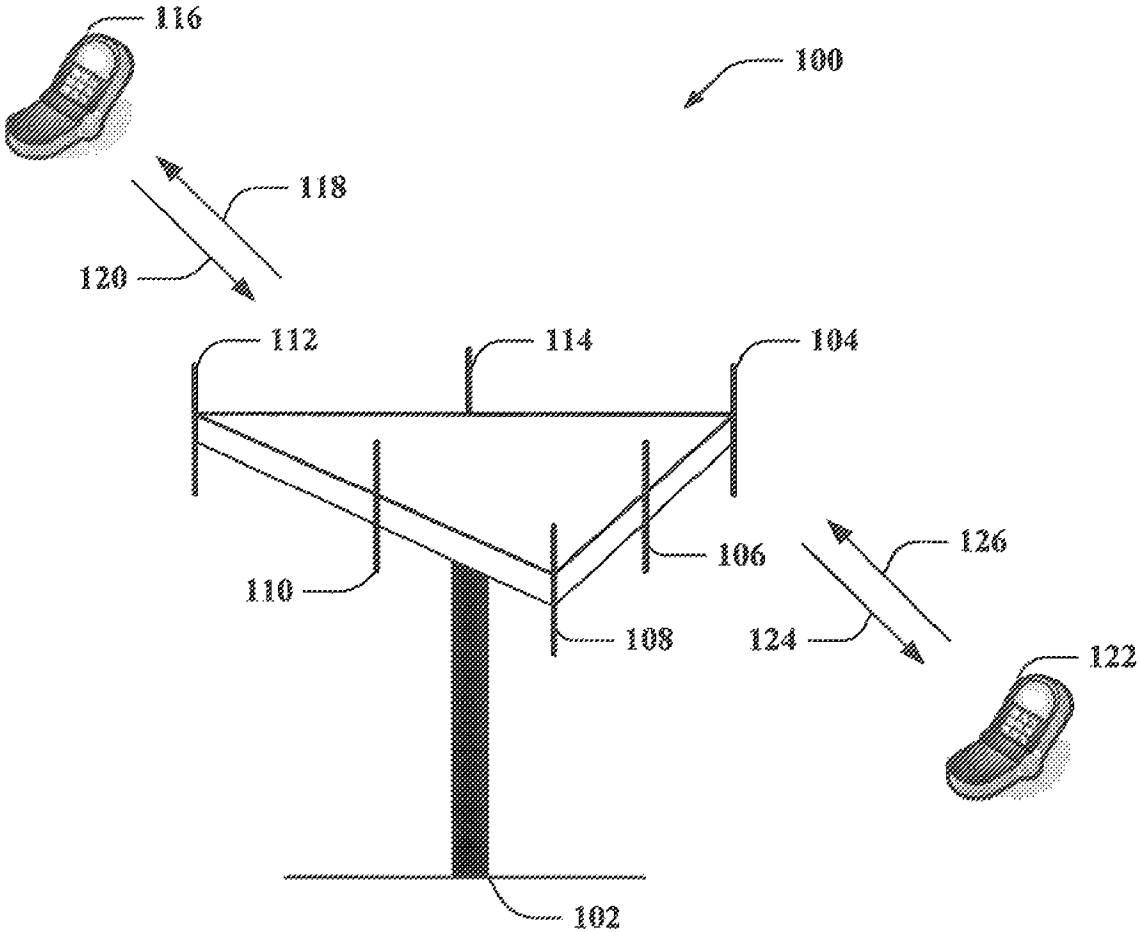
FIG. 1 is an illustration of a wireless communication system in accordance with various aspects set forth herein.

Various embodiments are now described with reference to the drawings, wherein like reference numerals are used to refer to like elements throughout. In the following description, for purposes of explanation, numerous specific details are set forth in order to provide a thorough understanding of one or more embodiments. It may be evident, however, that such embodiment(s) may be practiced without these specific details. In other instances, well-known structures and devices are shown in block diagram form in order to facilitate describing one or more embodiments.

As used in this application, the terms "component," "module," "system," and the like are intended to refer to a computer-related entity, either hardware, firmware, a combination of hardware and software, software, or software in execution. For example, a component may be, but is not limited to being, a process running on a processor, a processor, an object, an executable, a thread of execution, a program, and/or a computer. By way of illustration, both an application running on a computing device and the computing device can be a component. One or more components can reside within a process and/or thread of execution and a component may be localized on one computer and/or distributed between two or more computers. In addition, these components can execute from various computer readable media having various data structures stored thereon. The components may communicate by way of local and/or remote processes such as in accordance with a signal having one or more data packets (e.g., data from one component interacting with another component in a local system, distributed system, and/or across a network such as the Internet with other systems by way of the signal).

Furthermore, various embodiments are described herein in connection with a wireless terminal. A wireless terminal can also be called a system, subscriber unit, subscriber station, mobile station, mobile, mobile device, remote station, remote terminal, access terminal, user terminal, terminal, wireless communication device, user agent, user device, or user equipment (UE). A wireless terminal may be a cellular telephone, a cordless telephone, a Session Initiation Protocol (SIP) phone, a wireless local loop (WLL) station, a personal digital assistant (PDA), a handheld device having wireless connection capability, computing device, or other processing device connected to a wireless modem. According to another example, a wireless terminal may be a wireless data card or embedded module inside another device such as a laptop computer or PDA. Moreover, various embodiments are described herein in connection with a base station. A base station may be utilized for communicating with wireless terminal(s) and may also be referred to as an access point, Node B, or some other terminology.

Moreover, various aspects or features described herein may be implemented as a method, apparatus, or article of manufacture using standard programming and/or engineering techniques. The term "article of manufacture" as used herein is intended to encompass a computer program accessible from any computer-readable device, carrier, or media. For example, computer-readable media can include but are not limited to magnetic storage devices (e.g., hard disk, floppy disk, magnetic strips, etc.), optical disks (e.g., compact disk (CD), digital versatile disk (DVD), etc.), smart cards, and flash memory devices (e.g., EPROM, card, stick, key drive, etc.). Additionally, various storage media described herein can represent one or more devices and/or other machine-readable media for storing information. The term "machine-readable medium" can include, without being limited to, wireless channels and various other media capable of storing, containing, and/or carrying instruction(s) and/or data.

Referring now to FIG. 1, a wireless communication system 100 is illustrated in accordance with various embodiments presented herein. System 100 comprises a base station 102 that can include multiple antenna groups. For example, one antenna group can include antennas 104 and 106, another group can comprise antennas 108 and 110, and an additional group may include antennas 112 and 114. Two antennas are illustrated for each antenna group; however, more or fewer antennas may be utilized for each group. Base station 102 can additional include a transmitter chain and a receiver chain, each of which can in turn comprise a plurality of components associated with signal transmission and reception (e.g., processors, modulators, multiplexers, demodulators, demultiplexers, antennas, etc.), as will be appreciated by one skilled in the art.

Base station 102 can communicate with one or more mobile devices such as mobile device 116 and mobile device 122; however, it is to be appreciated that base station 102 can communicate with substantially any number of mobile devices similar to mobile devices 116 and 122. Mobile devices 116 and 122 can be, for example, cellular phones, smart phones, laptops, PC cards, handheld communication devices, handheld computing devices, satellite radios, global positioning systems, PDAs, wireless data cards or embedded modules inside other devices such as laptop computers or PDAs, and/or any other suitable devices for communicating over wireless communication system 100. As depicted, mobile device 116 is in communication with antennas 112 and 114, where antennas 112 and 114 transmit information to mobile device 116 over a forward link 118 and receive information from mobile device 116 over a reverse link 120. Moreover, mobile device 122 is in communication with antennas 104 and 106, where antennas 104 and 106 transmit information to mobile device 122 over a forward link 124 and receive information from mobile device 122 over a reverse link 126. In a frequency division duplex (FDD) system, forward link 118 may utilize a different frequency band than that used by reverse link 120, and forward link 124 may employ a different frequency band than that employed by reverse link 126, for example. Further, in a time division duplex (TDD) system, forward link 118 and reverse link 120 may utilize a common frequency band and forward link 124 and reverse link 126 may utilize a common frequency band.

Each group of antennas and/or the area in which they are designated to communicate can be referred to as a sector of base station 102. For example, antenna groups can be designed to communicate to mobile devices in a sector of the areas covered by base station 102. In communication over forward links 118 and 124, the transmitting antennas of base station 102 may utilize beamforming to improve signal-to-noise ratio of forward links 118 and 124 for mobile devices 116 and 122. Also, while base station 102 utilizes beamforming to transmit to mobile devices 116 and 122 scattered randomly through an associated coverage, mobile devices in neighboring cells may be subject to less interference as compared to a base station transmitting through a single antenna to all its mobile devices.

Mobile devices 116 and 122 can additionally leverage MIMO antenna structures for communicating with base station 102. For instance, such MIMO antenna structures can be easily manufactured, low cost structures with small sizes that yield improved performance as compared to conventional MIMO devices. Moreover, the MIMO antenna structures can include multiple antenna elements that can be printed on flexible material (e.g., flex circuit) that is folded accordion (book) style. Further, the flexible material can be placed between a circuit board and a movable lid. Thus, when the lid is unhinged, the flex material can expand and the antenna can be deployed for operation. Additionally, from the extended position, the antenna can be folded under the lid to be returned to the closed position.

It is contemplated that a MIMO antenna structure can be permanently incorporated into mobile devices 116 and 122. Additionally or alternatively, the MIMO antenna structure can be removable and/or replaceable; thus, the MIMO antenna structure can be removably attached to mobile devices 116 and 122. For example, the MIMO antenna structures can be replaced when damaged. According to another illustration, disparate MIMO antenna structures can operate in differing frequency bands, and therefore, the structures can be switched depending on frequency range upon which communication occurs.

Figure 2:
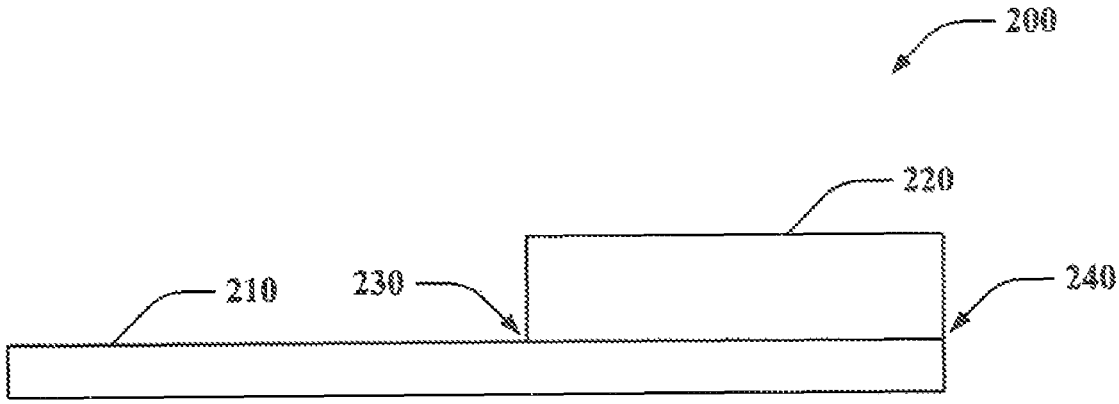
FIG. 2 is an illustration of a wireless system in accordance with various aspects presented herein.

Turning to FIG. 2, illustrated is a wireless system 200 in accordance with various aspects presented herein. System 200 includes a PC card 210 and an antenna housing 220 incorporated therewith. PC card 210 may enable communication over a wireless communication network.

Antenna housing 220 is illustrated in a closed or locked position. In the closed or locked position, an antenna structure is collapsed and protected within antenna housing 220. Further, in the closed or locked position, PC card 210 and antenna housing 220 comprise a form factor similar to common WiFi PC cards or other such PC cards including a conventional bulb-type antenna. Accordingly, PC card 210 with antenna housing 220 in the closed or locked position conveniently stores the wireless communication components efficiently and compactly. Moreover, while in the closed or locked position, the antenna structure within antenna housing 220 can transmit and/or receive data; however, reception and/or transmission can be improved when the antenna housing 220 is in an expanded state.

Further, antenna housing 220 can move from the closed or locked position. For instance, antenna housing 220 can be rotated with respect to PC card 210 to transition into an expanded position (e.g., via a hinge, pin, joint, coupler, . . . ). Antenna housing 220, for example, can rotate around juncture 230 to open towards a portion of PC card 210 that can be inserted into a PCMCIA slot of a disparate device (not shown). Pursuant to another example, antenna housing 220 can rotate around juncture 240 to open away from such portion of PC card 210 that can be inserted into a PCMCIA slot. Further, antenna housing 220 can rotate along a side edge of PC card 210 to open parallel to a PCMCIA slot in which PC card 210 can be inserted, for example.

Figure 3:
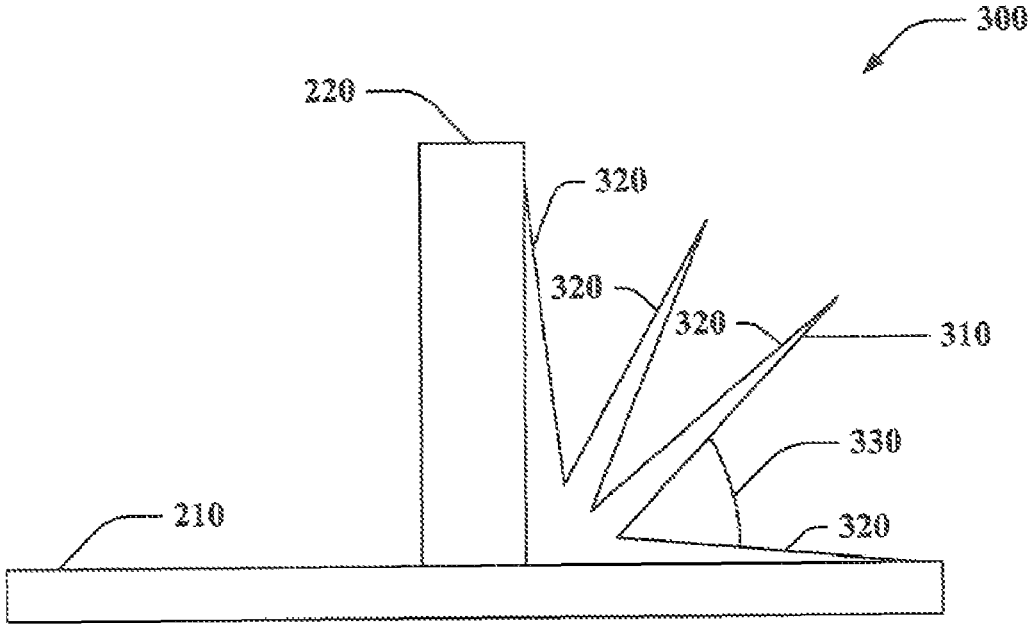
FIG. 3 is an illustration of a multiple antenna structure in accordance with an aspect presented herein.

Referring now to FIG. 3, illustrated is a system 300 that includes PC card 210 and antenna housing 220. As depicted in system 300, antenna housing 220 is in the open or deployed position (e.g., rotated about junction 230 from FIG. 2). When antenna housing 220 is moved from the closed position to the deployed position, an antenna structure 310 is exposed. Antenna structure 310 is folded such that it expands and collapses like an accordion when antenna housing 220 switches between the deployed position and the closed position. A user can press down upon antenna housing 220 and, accordingly, fold antenna structure 310 under antenna housing 220 until the housing 220 returns to the closed position and locks with PC card 210 as depicted in FIG. 2.

Antenna structure 310 can be composed of a flexible material such as, for example, a flex circuit; thus, the flexible material can allow for folding of antenna structure 310. It is to be appreciated that any flexible electrical component can be utilized in place of a flex circuit. One end of the flex circuit of antenna structure 310 can be attached to a circuit board (e.g., associated with PC card 210). Accordingly, electrical signals can be conveyed from antenna structure 310 to a device with a PCMCIA slot employing system 300 via PC card 210. The other end of the flex circuit of antenna structure 310 can be attached to the movable antenna housing 220 such that antenna structure 310 can be folded accordion-style as antenna housing 220 is moved between the open and closed positions.

System 300 depicts antenna structure 310 that includes four surfaces 320 upon which antennas can be positioned; however, it should be appreciated that any number of surfaces may be utilized depending on the geometry of antenna structure 310 (e.g., number of folds utilized) manufactured or implemented. An antenna (not shown) can be printed or deposited on each surface 320 of the flex circuit material of antenna structure 310. Each antenna printed on the flex circuit can be utilized for operation within a common frequency band and/or differing frequency bands. For example, an antenna printed on one of the surfaces 320 of antenna structure 310 can be utilized to operate at 400 MHz, while another antenna deposited on another surface 320 of antenna structure 310 can be employed for operating at 3.5 GHz. Further, it is to be appreciated that the printed antennas can be operable on multiple frequencies between 400 MHz and 3.5 GHz and/or any other frequency band.

Figure 4:
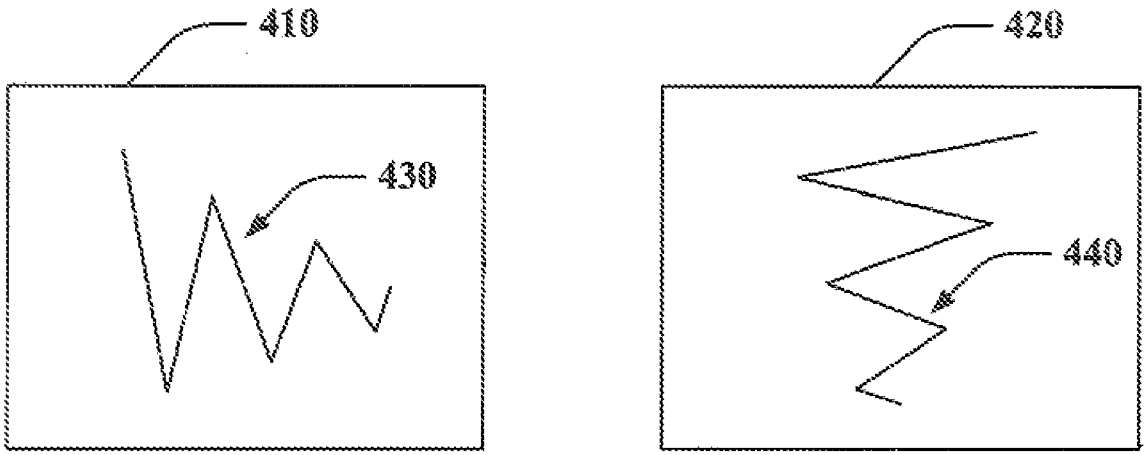
FIG. 4 is an illustration of example flex circuit surfaces of an antenna structure.

Turning briefly to FIG. 4, representative flex circuit surfaces 410 and 420 of an antenna structure (e.g., antenna structure 310 from FIG. 3) are illustrated. It is to be appreciated that surfaces 410 and 420 can be any of the plurality of surfaces 320 from antenna structure 310. Moreover, antennas 430 and 440 are printed on surfaces 410 and 420, respectively. Antennas 430 and 440 can be employed for different operations at different frequencies. Additionally or alternatively, antennas 430 and 440 can operate over shared frequency ranges. It should be appreciated that antennas 430 and 440 can be utilized for the substantially similar operation, thus, providing multiple communication channels resulting in greater throughput and information transmission rates.

Antennas 430 and 440 are depicted as being offset relative to one another. Accordingly, antennas 430 and 440 can provide polarization diversity based upon the alignment of the radiating element upon each of the surfaces 410 and 420. Such polarization diversity can mitigate interference between antennas 430 and 440, and thus, improve overall MIMO performance. It is to be appreciated that substantially any offset angle between antennas 430 and 440 can be employed to create such polarization diversity.

Referring once again to FIG. 3, vertical and horizontal polarization diversity can be achieved by the 3-dimensional nature of antenna structure 310. Antenna structure 310 can be fanned out such that surfaces 320 can be separated approximately by an angle 330. Substantially any angle magnitude can be employed depending on the amount of polarization diversity desired or the number of antennas implemented with the antenna structure 310. For example, a small magnitude for angle 330 allows for more folds of antenna structure 310 and, accordingly, a greater number of surfaces 320 (and corresponding antennas). Conversely, a large value of angle 330 results in fewer folds and, subsequently, a lesser number of surfaces 320 (and corresponding antennas). Further, a small angle magnitude creates a lesser degree of vertical and horizontal polarization diversity than does a large angle value. According to an example, angle 330 can be 30-45°. However, it should be appreciated that angles outside this range can be employed. Thus, antennas printed onto surfaces 320 of the flex circuit of antenna structure 310 can be positioned at differing horizontal and vertical locations in addition to being offset from one another upon each of the surfaces 320 to yield polarization diversity. Moreover, the differing horizontal and vertical locations of antenna elements can yield spatial diversity. It is to be appreciated that vertical or horizontal offsetting alone can be employed. For example, antenna housing 220, rather than rotating open in a counter-clockwise fashion as depicted, can move linearly in a direction away from PC card 110 to yield vertical diversity between antennas (e.g., with or without offsets of radiating elements upon surfaces 320).

By leveraging three dimensional antenna structure 310, system 300 can provide advantages in comparison to conventional printed two dimensional antennas or chip antennas. For instance, antenna structure 310 can accommodate a plurality of antennas in a small form factor (e.g., switchable such that four antennas can be utilized to receive four different data streams on a downlink, can be employed to transmit with the four antennas on an uplink, . . . ). Further, antenna structure 310 can provide improved polarization diversity compared to traditional antennas. Moreover, beam forming can be performed by utilizing antenna structure 310 (e.g., steer antenna bandwidth/direction). Additionally, a larger vertically polarized component can be obtained with antenna structure 310 as compared to typical antennas. Also, more gain can be yielded in the direction of the horizontal axis of a device, while minimizing thickness of the device when stowed.

Figure 5:
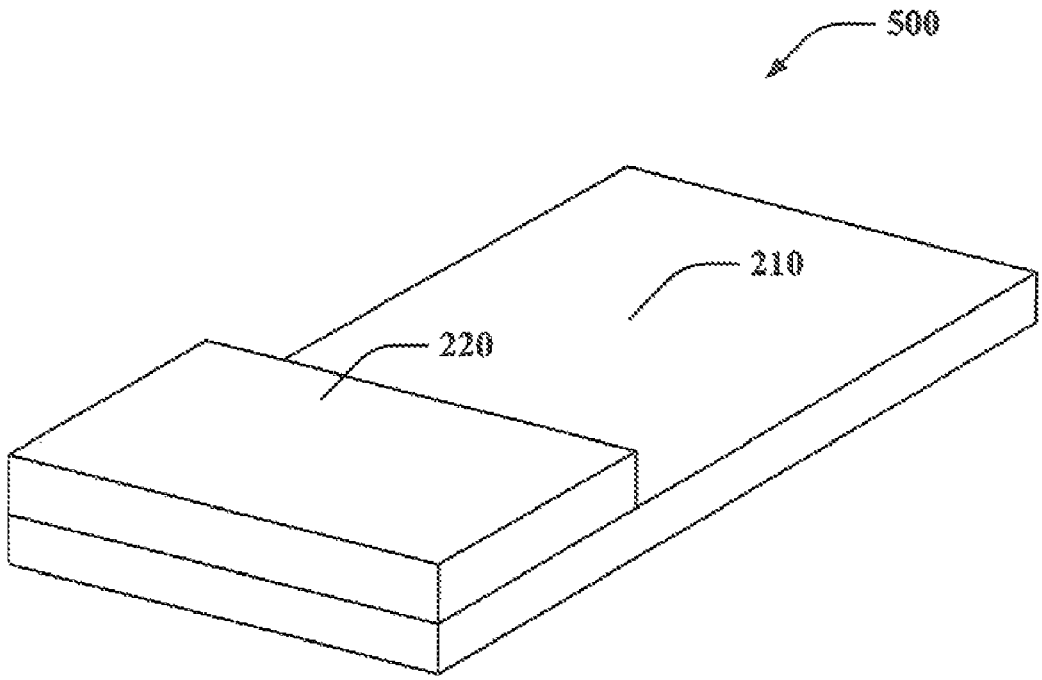
FIG. 5 is an illustration of an isometric projection of a system including a PC card with an expandable antenna housing integrated therewith.
Figure 6:
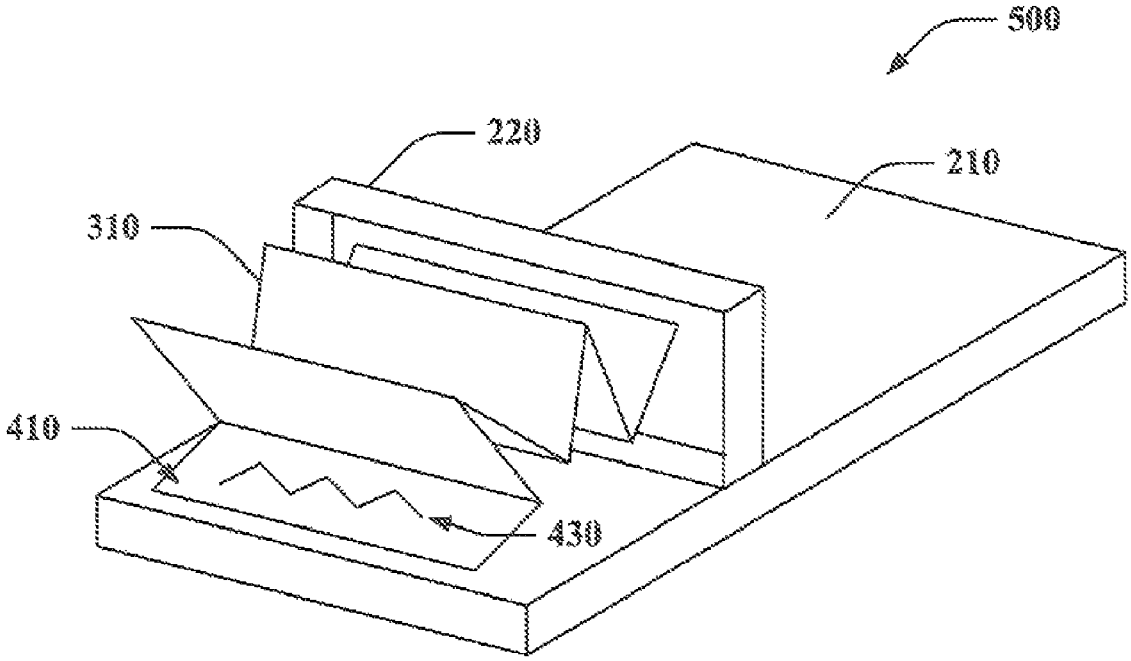
FIG. 6 is an illustration of an isometric projection of a system including a PC card with a multiple antenna structure deployed.

Turning now to FIGS. 5 and 6, an isometric projection of a system 500 is depicted including a PC card 210 with an expandable antenna housing 220 integrated therewith. In FIG. 5, antenna housing 220 is illustrated in the closed or locked position. In this position, the expandable antenna (e.g., antenna structure 310) is collapsed, stored and protected within antenna housing 220. Antenna housing 220 can be maintained in this position by a clasp or lock (not shown) operable between antenna housing 220 and PC card 210. For example, a magnetic fastener can be employed to hold antenna housing 220 in the closed position. Additionally or alternatively, it is to be appreciated that a latch, spring, clasp, cam, electronic lock, etc. can be utilized to retain antenna housing 220 in the closed position.

FIG. 6 illustrates an isometric projection of PC card 210 with antenna housing 220 in an open or deployed position. According to an example, antenna housing 220 can be deployed to the open position manually. For instance, a user can press down on antenna housing 220 while in the closed position to release a fastener that holds antenna housing 220 closed. In response to being depressed, the fastener can disengage and thereby allow antenna housing 220 to rotate to the open position. For instance, a force can be applied to antenna housing 220 (e.g., by a user) to effectuate such rotation. Pursuant to another illustration, a spring, a screw drive, and/or the compressed antenna structure 310 can yield the force that rotates antenna housing 220. Similarly, the antenna housing 220 can also be returned to the closed or locked position manually. The user can press down upon antenna housing 220 until the fastener engages antenna housing 220 to PC card 210 and locks antenna housing 220 into the closed position. According to another example, a motor (not shown) can move antenna housing 220 between the closed and open positions.

When antenna housing 220 is moved to the open position, antenna structure 310 unfolds for operation. As discussed supra, antenna structure 310 expands accordion-style such that antenna structure 310 unfolds and folds as antenna housing 220 is moved between the open and closed positions, respectively. Further, the folds of antenna structure 310 provide a plurality of surfaces of the flex circuit. Antennas can be printed on some of the plurality of surfaces of the flex circuit. For example, FIG. 6 depicts antenna 430 printed on surface 410 (e.g., from FIG. 4) of the flex circuit of antenna structure 310. Also, according to the illustrated example, antenna structure 310 can include additional surfaces upon which antennas can be printed.

Figure 7:
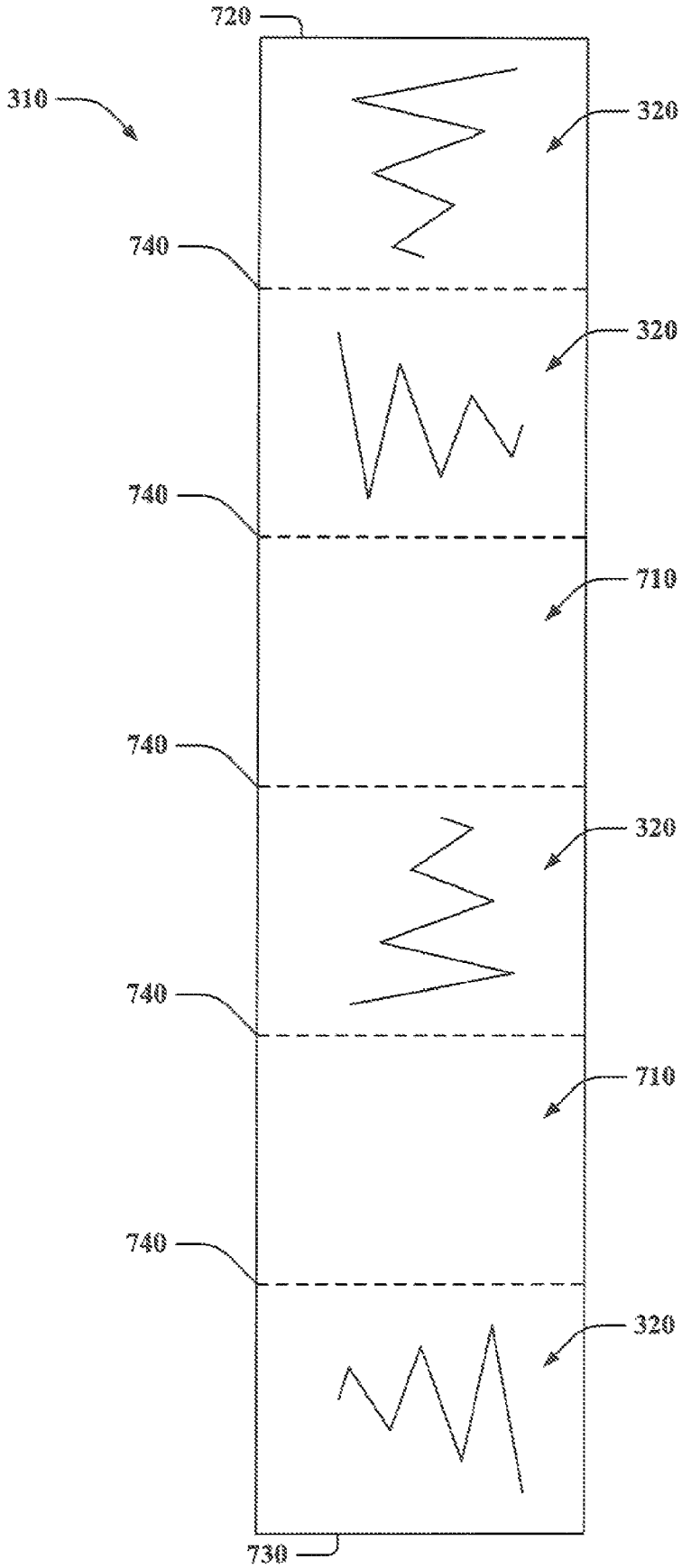
FIG. 7 is an illustration of plan view of an antenna structure.

With reference to FIG. 7, illustrated is a plan view of an antenna structure 310. Antenna structure 310 includes surfaces 320 (e.g., surfaces 410 and 420) that can have antennas (e.g., radiating elements) printed, deposited, formed, etc. thereupon. Each antenna upon each surface 320 can be offset from the other antennas upon the other surfaces 320. It is contemplated that substantially any offset between the antennas can be utilized. Further, the antennas can be substantially similar to one another and/or can differ (e.g., transmit and/or receive data over similar and/or disparate frequency bands). Additionally, antenna structure 310 can include portions 710 that lack antennas. It is to be appreciated that antenna structure 310 is not limited to the illustrated example; rather, any number of surfaces 320 and portions 710 are contemplated. When fanned, each of the portions 710 can be in close proximity with a respective surface 320; thus, portions 710 need not include antennas since such antennas can interact with nearby antennas upon surfaces 320.

Antenna structure 310 can connect to a housing (e.g., antenna housing 220 of FIG. 2) at an end 720. Further, antenna structure 310 can connect to a PC card (e.g., PC card 210 of FIG. 2) at an end 730. Moreover, antenna structure 310 can be folded in an accordion fashion at dotted lines 740. Additionally, it is contemplated that an antenna located upon one of the surfaces 320 can extend onto one of the portions 710 to provide more length for such antenna (e.g., for operating at lower frequencies).

According to other examples, antenna 310 can utilize a common feedpoint into antenna elements and/or separate feedpoints into the antenna elements. By employing separate feedpoints into different antenna elements, duplex filtering can be reduced in connection with frequency division duplex (FDD) communications due to isolation provided by different antenna elements. Thus, instead of combining transmitter and receiver into a common feedpoint using a duplexing filter, transmitter and receiver can be fed into separate antenna elements through separate feedpoints; hence, filtering can be mitigated based upon an amount of antenna element to antenna element isolation yielded.

Figure 8:
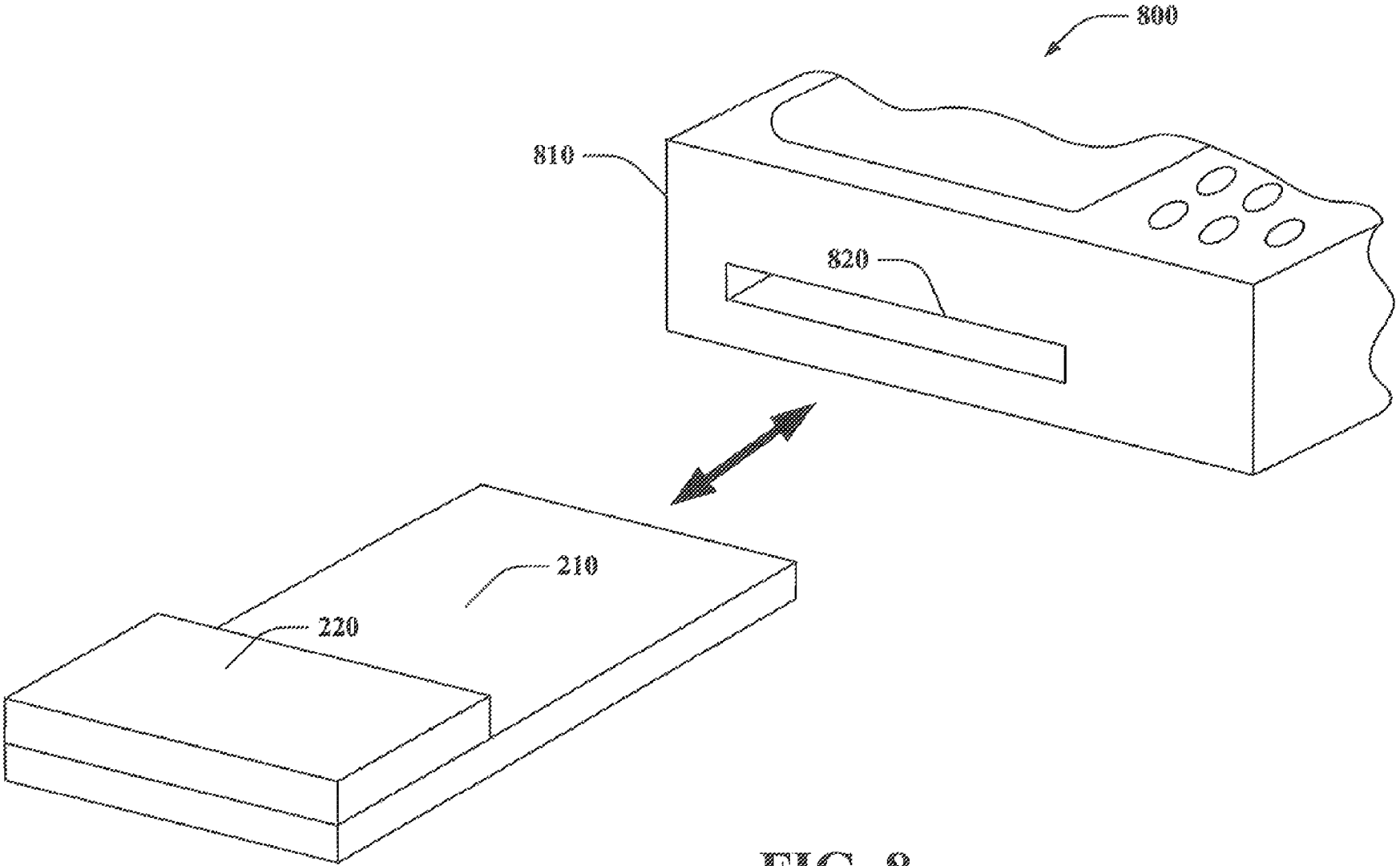
FIG. 8 is an illustration of an example system including a mobile device with an expandable antenna structure.

Turning now to FIG. 8, illustrated is a system 800 including a mobile device 810. Mobile device 810, according to one example, can be a laptop. It is to be appreciated that mobile device 810 can also be a cellular telephone, PDA or the like. Mobile device 810 includes an expansion slot 820 operable to accept an expansion card such as, for example, PC card 210 including an expandable antenna. According to an example, mobile device 810 can be a laptop computer, expansion slot 820 can be a PCMCIA slot and PC card 210 can comply with the PCMCIA form factor. Similarly, according to another example, mobile device 810 can be personal digital assistant (PDA). In such an example, expansion slot 520 can be a secure digital (SD) or other such slot. Card 210 can be an SDIO card complying with the SD form factor.

Figure 9:
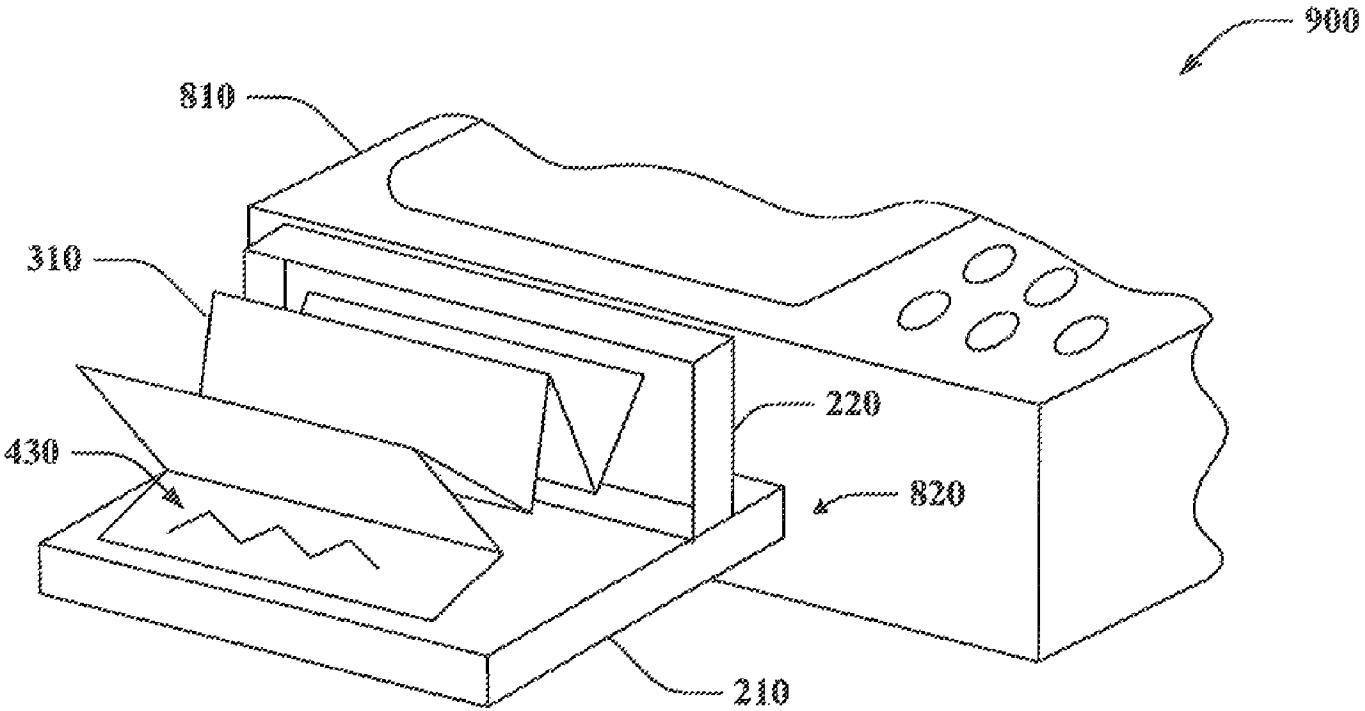
FIG. 9 is an illustration of a system with a card inserted into expansion slot of mobile device.

Referring to FIG. 9, system 900 depicts card 210 inserted into expansion slot 820 of mobile device 810. Upon insertion, antenna housing 220, according to an example, can automatically deploy to the open position as shown. Antenna housing 220 may also be manually deployed by a user or deployed in response to a signal sent to card 210 from mobile device 810. When housing 220 is in the open position, antenna structure 310 unfolds for operation. A plurality of antennas (e.g., including antenna 430) are printed on surfaces of the flex circuit of antenna structure 310. The plurality of antennas can be employed for different operations (e.g., an antenna may be employed for one function at a particular frequency and a disparate antenna may be employed for a different function at a different frequency). Antenna structure 310 can provide multiple-input and multiple-output functionality on a wireless network system to mobile device 810. Further, the antennas may be utilized in parallel for the same function at similar frequencies resulting in greater throughput.

Mobile device 810 can include software operable to control the operation of card 210 and antenna structure 310. Thus, mobile device 810, via card 210, can specify which antenna among the plurality of antennas is to be utilized at any particular time and for what function. For example, mobile device 810 can select a particular antenna for transmission of uplink data while a differing antenna can be utilized for receiving downlink data. According to another illustration, the antennas can be employed in parallel for a common operation (e.g., receiving downlink data), thus, increasing the rate at which data is received by the mobile device 810.

Figure 10:
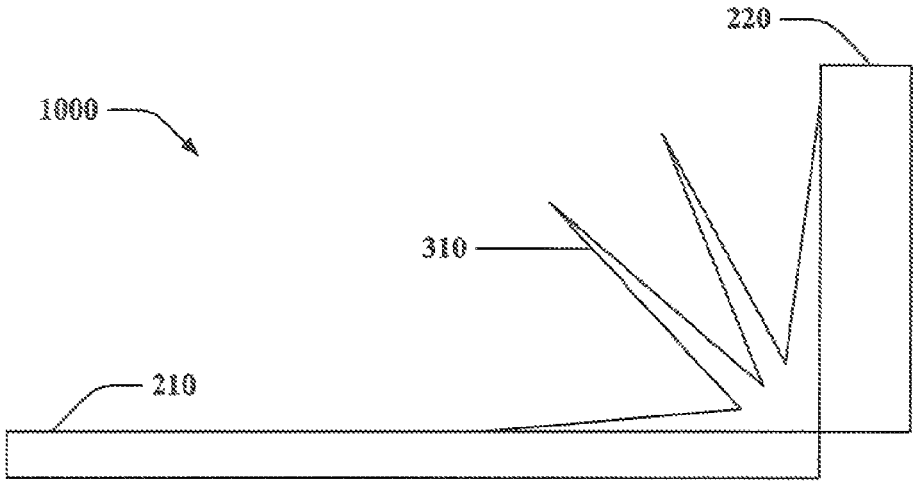
FIGS. 10-12 are illustrations of systems that include a PC card and an antenna housing.

With reference to FIG. 10, illustrated is a system 1000 that includes PC card 210 and antenna housing 220. Antenna housing 220 is illustrated in an open position with antenna structure 310 exposed. In particular, antenna housing 220 rotated around a junction (e.g., junction 240 of FIG. 2) to open away from a portion of PC card 210 that can be inserted into a slot of a disparate device. As shown in this example, antenna housing 220 can rotate 90 degrees with respect to PC card 210; however, it is to be appreciated that the claimed subject matter is not so limited as any degree of rotation is contemplated.

Figure 11:
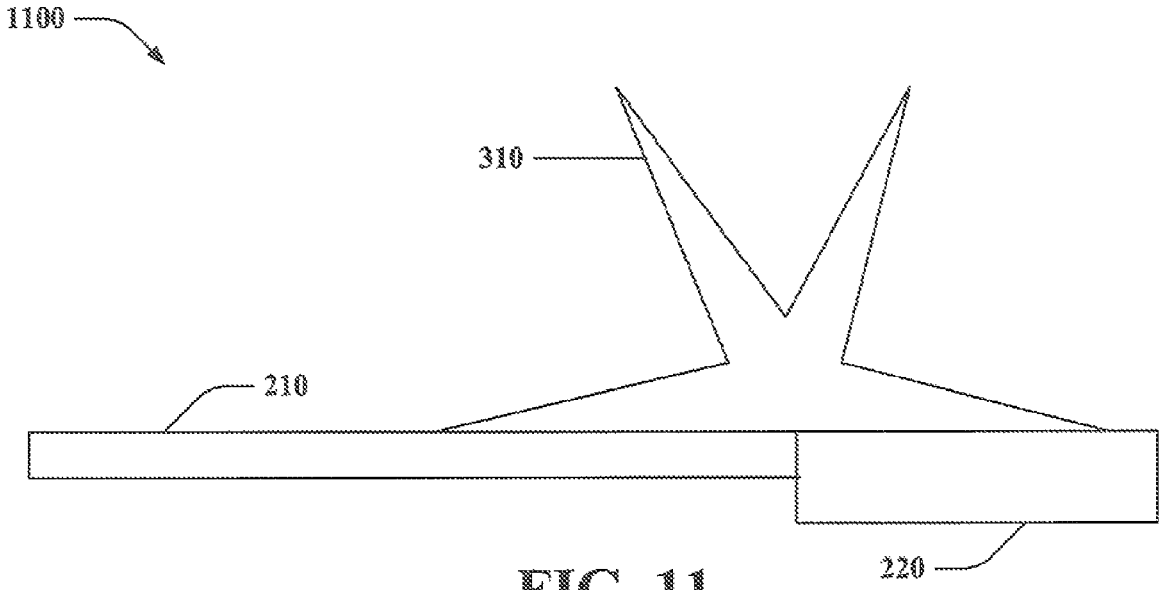

Turning to FIG. 11, illustrated is another system 1100 that includes PC card 210 and antenna housing 220. Similar to FIG. 10, antenna housing 220 can open away from a portion of PC card 210 that can be inserted into a slot of a disparate device. Moreover, antenna housing 220 can be rotated 180 degrees with respect to PC card 210. It is contemplated that antenna housing 220 can be positioned in the closed position, opened at 90 degrees as shown in FIG. 10, opened at 180 degrees, transitioned there between, etc. depending upon a type of operation being effectuated. Moreover, it is to be appreciated that antenna housing 220, when rotating towards a portion of PC card 210 that can be inserted into a slot, can rotate 180 degrees (as opposed to 90 degrees as shown in FIG. 3), for example, by PC card 210 extending outward (e.g., moving a center of rotation for antenna housing 220 away from an end of PC card 210 to be inserted into the slot) and antenna housing 220 thereafter rotating open.

Figure 12:
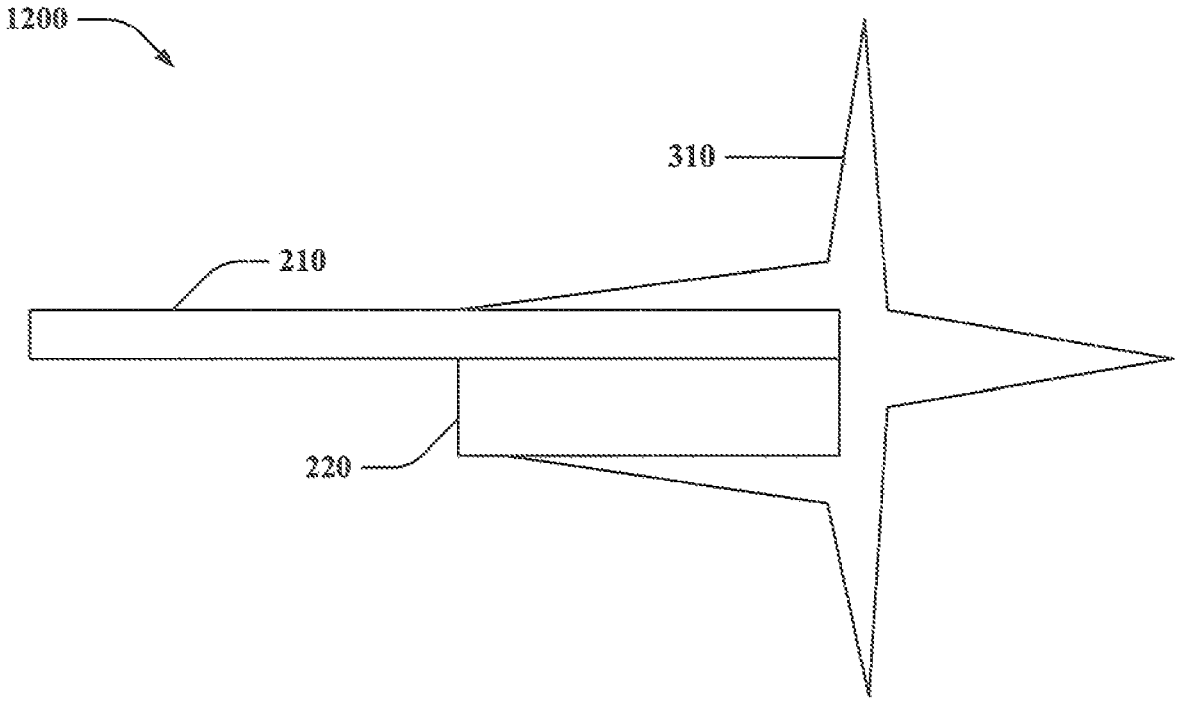

With reference to FIG. 12, illustrated is a further example of a system 1200 that includes PC card 210 and antenna housing 220. According to this example, antenna housing 220 can rotate approximately 360 degrees with respect to PC card 210. It is to be appreciated that antenna housing 220 can rotate to substantially any angle with respect to PC card 210.

Figure 13:
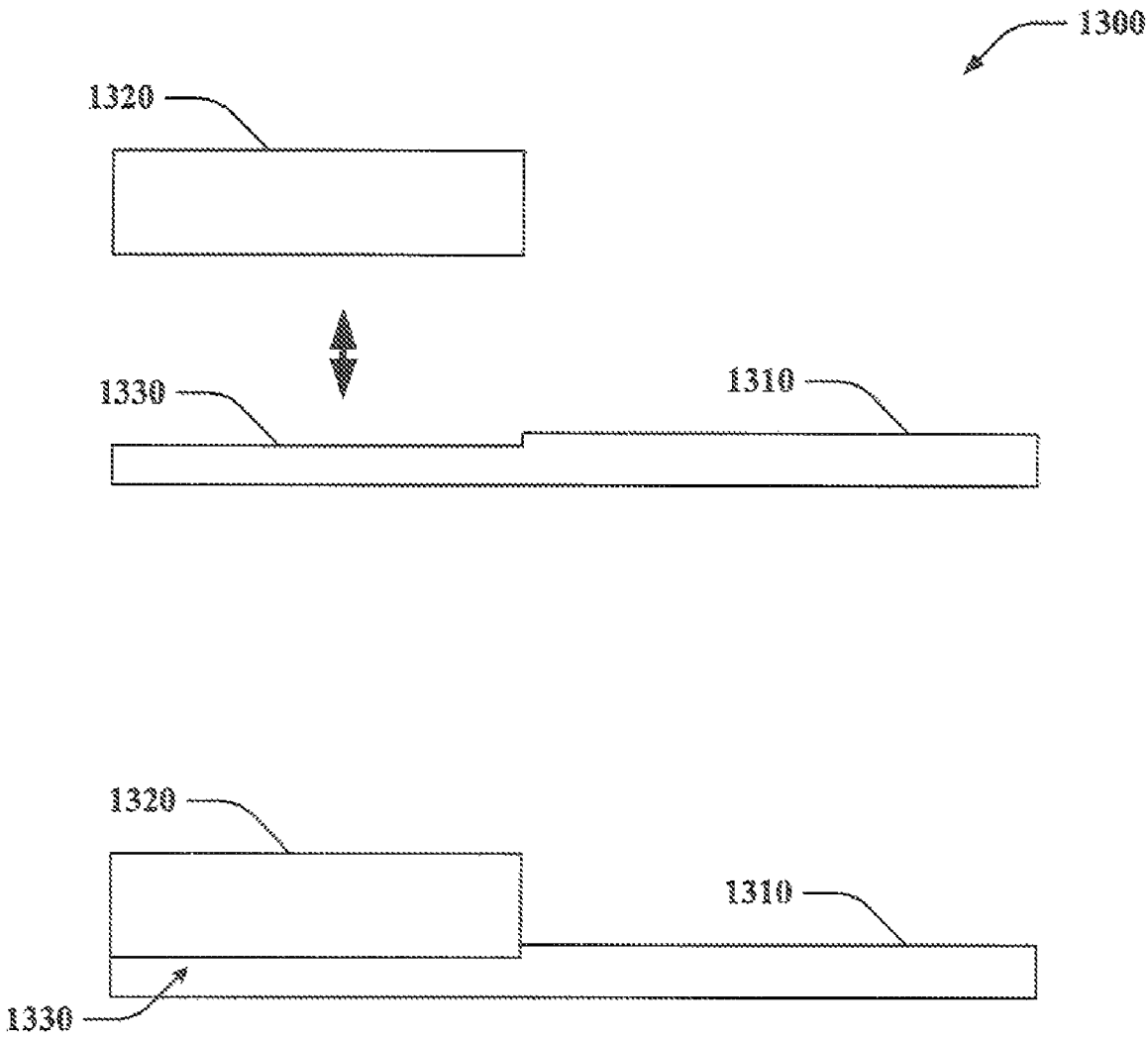
FIG. 13 is an illustration of a system that enables antenna expansion and/or replacement.

Turning now to FIG. 13, illustrated is a system 1300 that enables antenna expansion and/or replacement. System 1300 includes a PC card 1310 similar to card 210 from FIG. 2. Further, a modular antenna complex 1320 is provided. Antenna complex 1320 comprises an expandable antenna structure similar to antenna structure 310 described with reference to FIG. 3. Card 1310 includes a connector 1330 operable to engage with modular antenna complex 1320 to provide card 1310 with an expandable antenna structure included in antenna complex 1320. Thus, card 1310 can be provided with an expandable antenna for multiple-input, multiple output operations without having to be manufactured with such an antenna already integrated. For example, upon being coupled to connector 1330, modular antenna complex 1320 can be deployed to an open position. Further, a card 1310 can be upgraded from a single antenna to a multiple antenna system as described in the subject disclosure. It is to be appreciated that antenna complex 1320 can be attached to connector 1330 in any manner and is not limited to the illustrated example.

Figure 14:
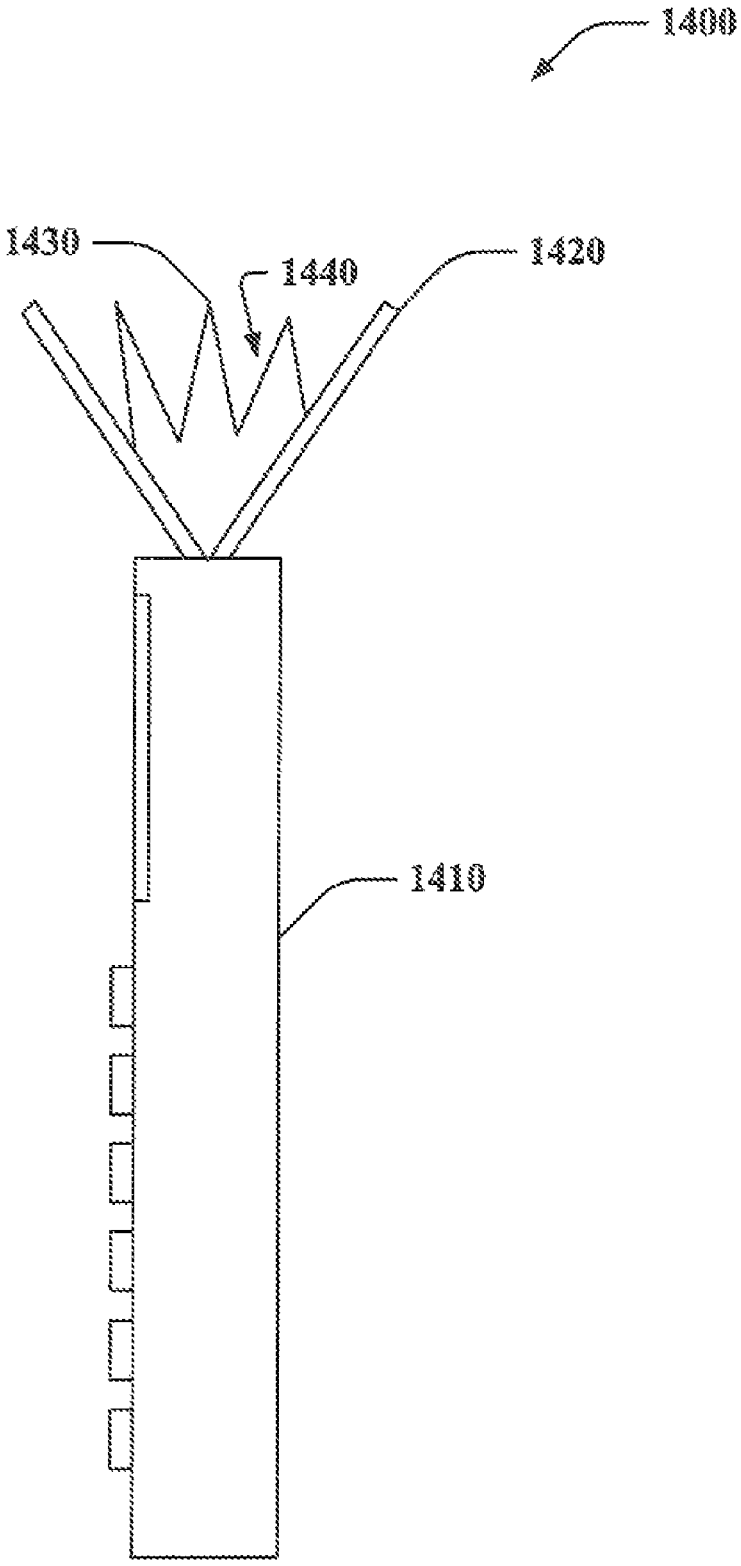
FIGS. 14-17 are illustrations of systems that enable MIMO communication.

Turning now to FIG. 14, illustrated is a system 1400 that enables MIMO communication. System 1400 includes a device 1410 such as cellular telephone, smart phone, or PDA. Device 1410 includes an expandable antenna unit 1420 (e.g., antenna housing 220 of FIG. 2). Antenna unit 1420 can fold similar to a book and retract into a housing of device 1410 when not being utilized. Antenna unit 1420 includes a flex circuit 1430 (e.g., antenna structure 310 of FIG. 3) attached at both ends to antenna unit 1420. The accordion-style folding of flex circuit 1430 creates a plurality of surfaces such as surface 1440. An antenna can be printed or deposited on surface 1440 of flex circuit 1430. Further, other antennas can be printed onto other surfaces of flex circuit 1430. The antennas can be operable for a variety of functions at a varying range of frequencies. Multiple antennas enable device 1410 to utilize multiple-input and multiple-out transmitters and receivers and, accordingly, increase user throughput.

Figure 15:
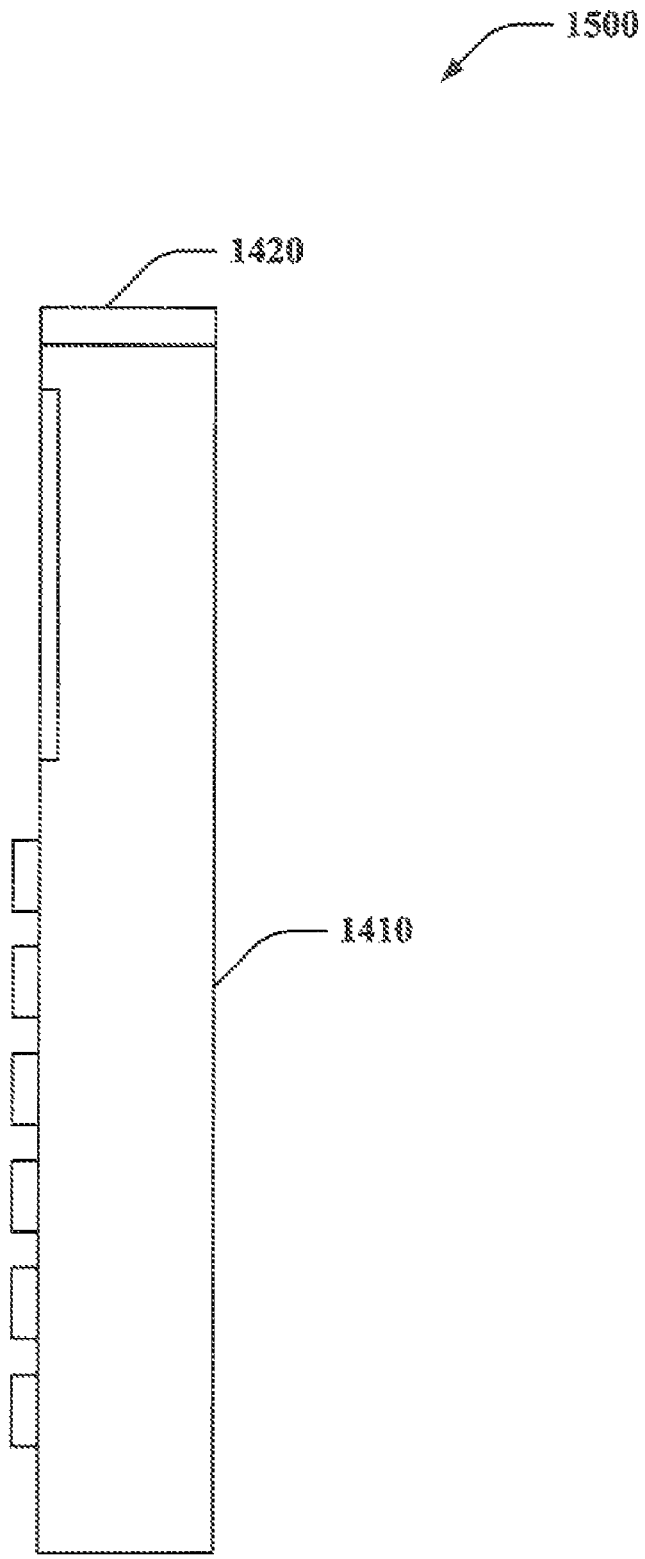

With reference to FIG. 15, illustrated is a system 1500 that includes a device 1410 and an expandable antenna unit 1420. Expandable antenna unit 1420 can extend across a top side of device 1410. As depicted, expandable antenna unit 1420 is in a closed position. From the closed position, expandable antenna unit 1420 can rotate and/or extend outwards to an open position (e.g., automatically, manually, . . . ).

Figure 16:
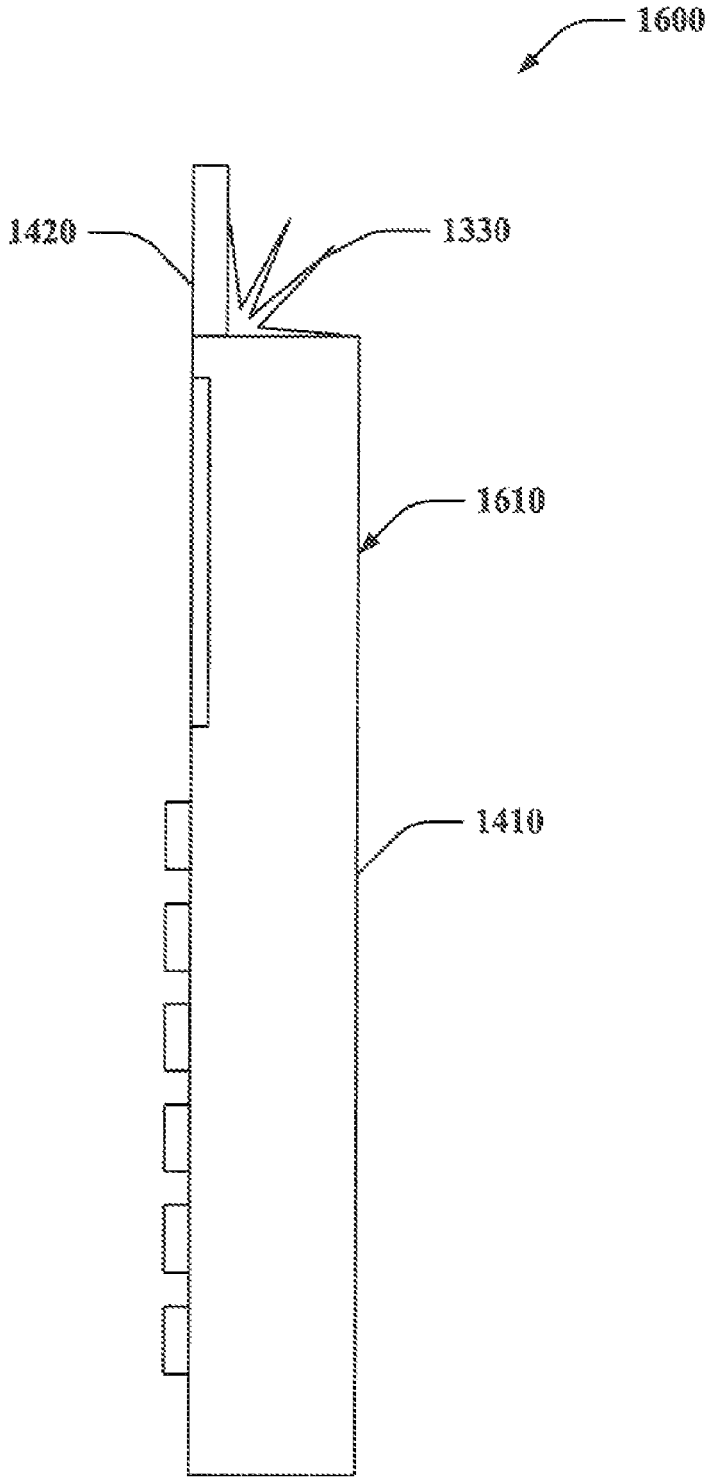

Turning to FIG. 16, illustrated is a system 1600 including a device 1410 with an expandable antenna unit 1420 in a deployed position. Expandable antenna unit 1420 can rotate open (e.g., from the closed position depicted in FIG. 15) to expose flex circuit 1430. Further, it is contemplated that expandable antenna unit 1420 can rotate about any other edge of device 1410. By rotating open, vertical and horizontal diversity of antennas included upon flex circuit 1430 can be obtained.

Expandable antenna unit 1420 can be positioned anywhere upon device 1410. For instance, expandable antenna unit 1420 can be mounted upon a back 1610 of device 1410. Moreover, it is contemplated that expandable antenna unit 1420 can open to substantially any angle (e.g., 90 degrees, 180 degrees, . . . ).

Figure 17:
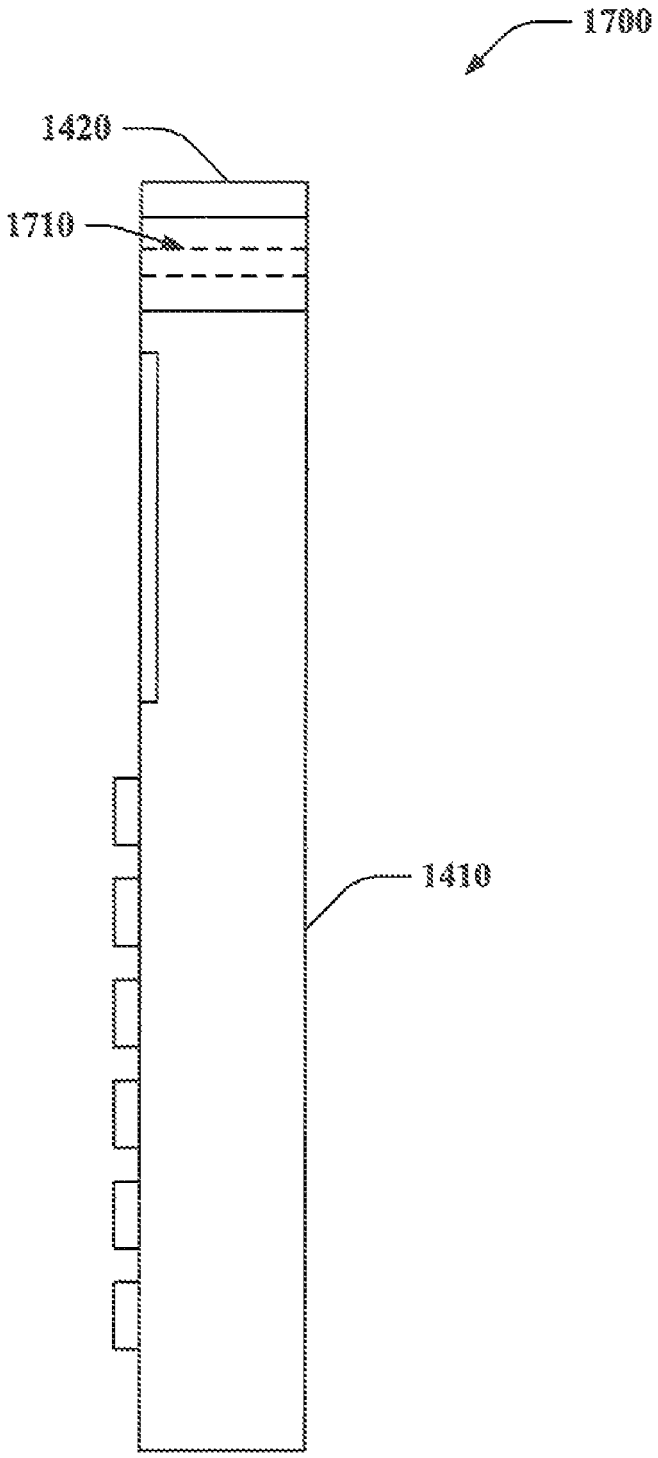

FIG. 17 illustrates a system 1700 that includes a device 1410 with a deployed expandable antenna unit 1420. Expandable antenna unit 1420 can linearly extend from device 1410. Thus, for instance, surfaces 1710 (e.g., and antennas included therewith) can be moved away from one another in one dimension when expandable antenna unit 1420 is in an open position (e.g., as compared to a closed position depicted in FIG. 15).

Figure 18:
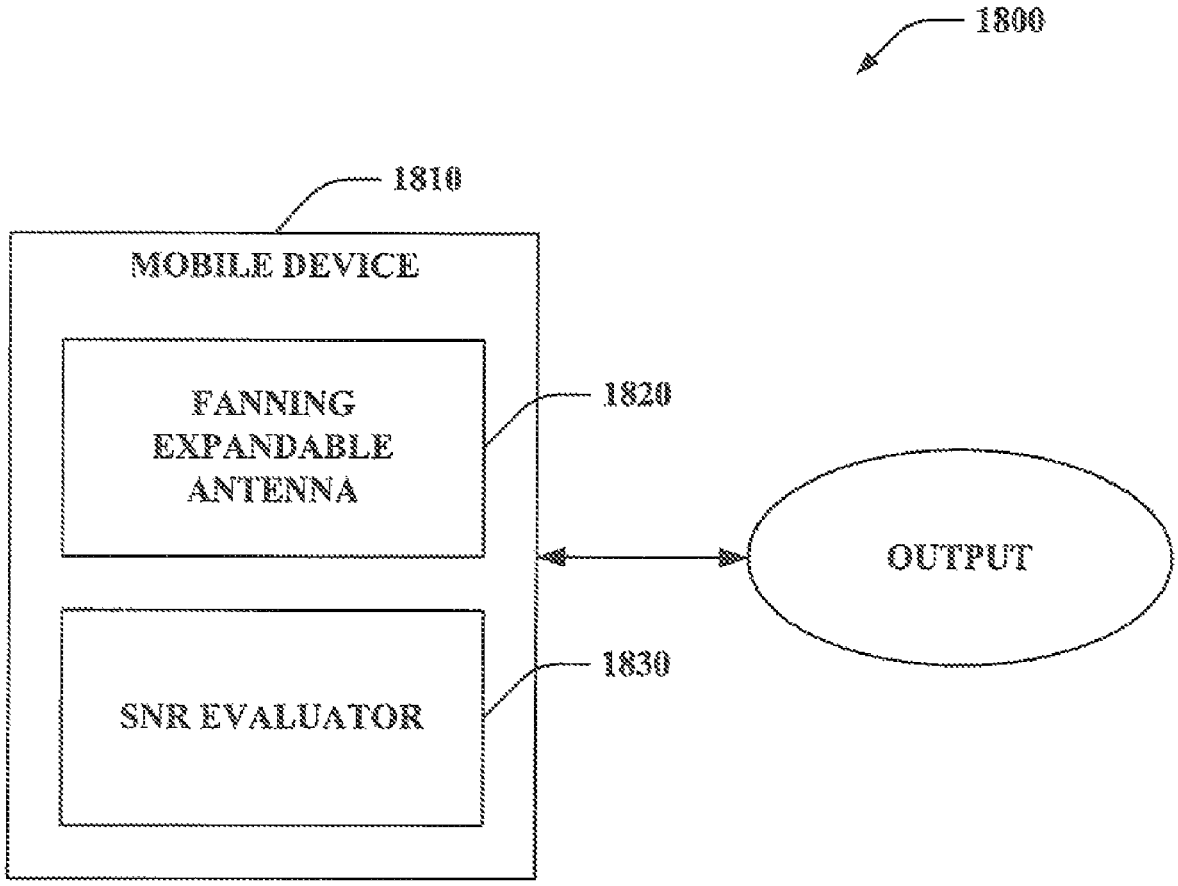
FIG. 18 is an illustration of a system that measures signal to noise ratios to effectuate deploying a MIMO antenna structure.

With reference to FIG. 18, illustrated is a system 1800 that measures signal to noise ratios to effectuate deploying a MIMO antenna structure. System 1800 includes a mobile device 1810 that further comprises a fanning expandable antenna 1820 (e.g., antenna housing 220 and antenna structure 310, expandable antenna unit 1420 and flex circuit 1430, . . . ). Fanning expandable antenna 1820 can transition between an open and closed position and can include a plurality of radiating elements positioned upon a flexible material that can be folded. Mobile device 1810 additionally includes a signal to noise ratio (SNR) evaluator 1830 that analyzes a SNR associated with fanning expandable antenna 1820. For example, SNR evaluator 1830 can determine whether a SNR is below a threshold when fanning expandable antenna 1820 is in a closed position. If the SNR is below such threshold, SNR evaluator 1830 can yield an appropriate output. According to another illustration, bit error rate and/or frame error rate can be estimated (e.g., by SNR evaluator 1830 or a disparate component), and such estimation can be compared to a corresponding threshold to yield an output as described below.

By way of illustration, the output from SNR evaluator 1830 can be a message presented to a user to prompt the user to move fanning expandable antenna 1820 into an open position. The message can be a visual notification displayed on a screen of mobile device 1810, an audio signal, a mechanical vibration, and the like. For instance, a user can be prompted to expand (and/or collapse) fanning expandable antenna 1820 in response to a message on a user interface. According to another example, the output can be an automatic expansion of fanning expandable antenna 1820 (e.g., without user manipulation of fanning expandable antenna 1820). Moreover, SNR evaluator 1830 can similarly provide an output that facilitates transitioning fanning expandable antenna 1820 to a closed position.

Figure 19:
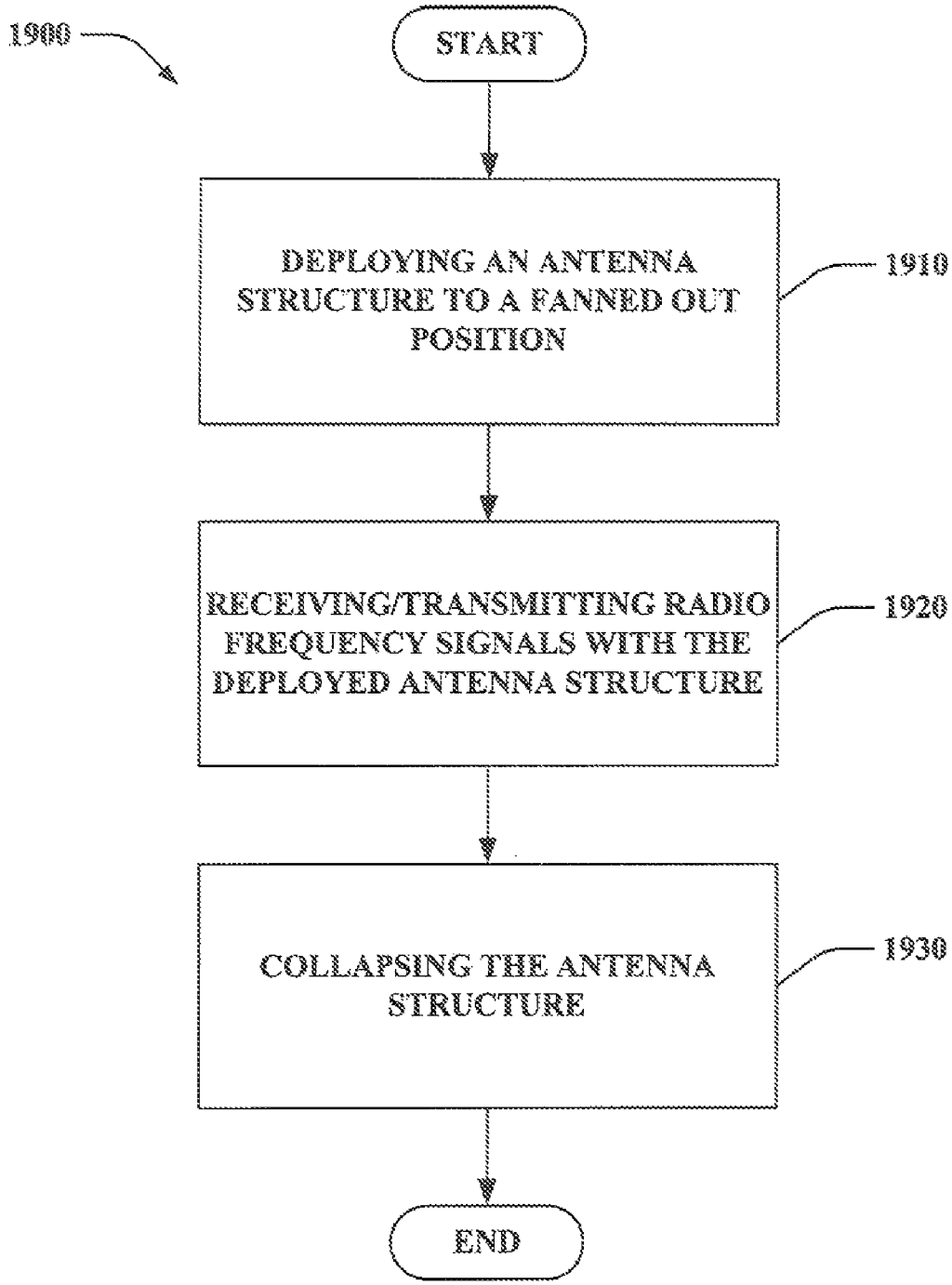
FIG. 19 is an illustration of a methodology that facilitates receiving and transmitting information via a multiple-input, multiple-output (MIMO) self-expandable antenna complex.
Figure 20:
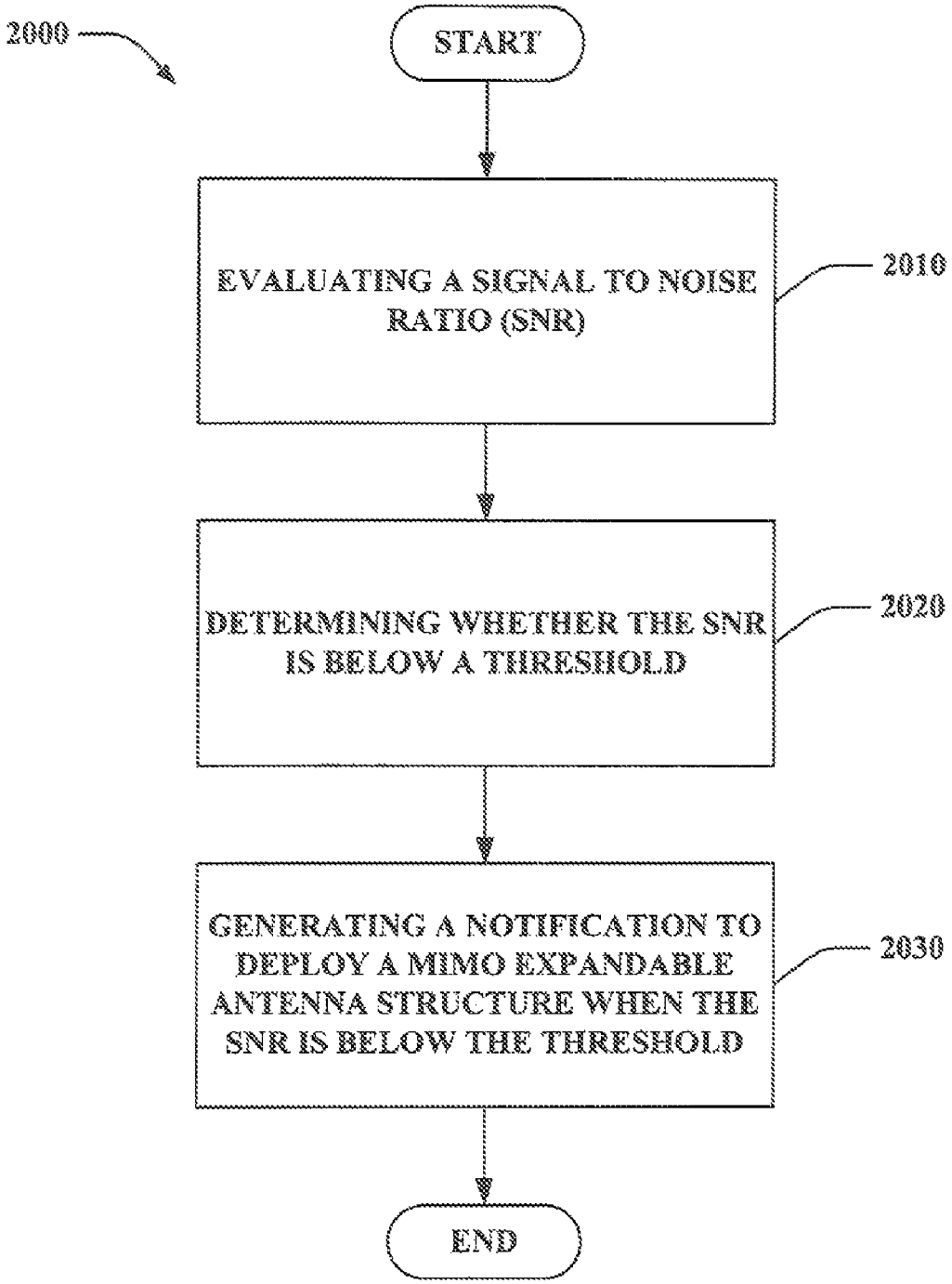
FIG. 20 is an illustration of a methodology that facilitates determining whether to deploy an expandable antenna structure.

Referring to FIGS. 19-20, methodologies relating to employing a self-expandable multiple-input, multiple-output antenna system as described supra are illustrated. While, for purposes of simplicity of explanation, the methodologies are shown and described as a series of acts, it is to be understood and appreciated that the methodologies are not limited by the order of acts, as some acts may, in accordance with one or more embodiments, occur in different orders and/or concurrently with other acts from that shown and described herein. For example, those skilled in the art will understand and appreciate that a methodology could alternatively be represented as a series of interrelated states or events, such as in a state diagram. Moreover, not all illustrated acts may be required to implement a methodology in accordance with one or more embodiments.

Turning now to FIG. 19, illustrated is a methodology 1900 that facilitates receiving and transmitting information via a multiple-input, multiple-output (MIMO) self-expandable antenna complex. At 1910, a MIMO antenna structure can be deployed to a fanned out position. The antenna structure can be held closed by an antenna housing that is locked by a clasp, lock, magnet, hinge, and the like. The lock can be released by an electronic signal sent to the antenna complex. Alternatively, the lock of the antenna housing can be released manually by a user of the antenna complex (e.g., by depressing the antenna housing to disengage the lock). While deployed for operation, a plurality of antenna elements printed on the antenna structure can be exposed. The antenna structure can rotate to an open or deployed position to diversify polarizations of the antenna elements horizontally and vertically.

At 1920, the antenna elements can receive and/or transmit radio frequency signals. The antenna elements can receive and transmit on the same frequency or a variety of frequencies in parallel. At 1930, the antenna structure collapses to a closed position. The antenna structure folds underneath the antenna housing for storage and protection. While collapsed, the antenna structure can provide a small form factor.

With reference to FIG. 20, illustrated is a methodology 2000 that facilitates determining whether to deploy an expandable antenna structure. At 2010, a signal to noise ratio (SNR) can be evaluated. For instance, the SNR can be analyzed while the expandable antenna structure is in a closed position. At 2020, a determination can be made as to whether the SNR is below a threshold. At 2030, a notification to deploy a MIMO expandable antenna structure can be generated when the SNR is below the threshold. For example, a visual display can be presented, an audible sound can be yielded, a movement can be provided, etc. Additionally or alternatively, the MIMO expandable antenna structure can automatically be moved to a deployed position. According to another example, a bit error rate and/or a frame error rate can be evaluated and compared to a threshold; based upon the comparison, a notification can be yielded when the evaluated rate is above a threshold.

It will be appreciated that, in accordance with one or more aspects described herein, inferences can be made regarding determining whether to deploy an expandable antenna structure. As used herein, the term to "infer" or "inference" refers generally to the process of reasoning about or inferring states of the system, environment, and/or user from a set of observations as captured via events and/or data. Inference can be employed to identify a specific context or action, or can generate a probability distribution over states, for example. The inference can be probabilistic—that is, the computation of a probability distribution over states of interest based on a consideration of data and events. Inference can also refer to techniques employed for composing higher-level events from a set of events and/or data. Such inference results in the construction of new events or actions from a set of observed events and/or stored event data, whether or not the events are correlated in close temporal proximity, and whether the events and data come from one or several event and data sources.

According to an example, one or more methods presented above can include making inferences pertaining to evaluating whether to deploy an expandable antenna structure. In accordance with another example, an inference can be made related to an expected SNR at a particular geographic location (e.g., based upon mobile device movement), and the expected SNR can be leveraged in connection with determining whether to deploy the expandable antenna structure. It will be appreciated that the foregoing examples are illustrative in nature and are not intended to limit the number of inferences that can be made or the manner in which such inferences are made in conjunction with the various embodiments and/or methods described herein.

Figure 21:
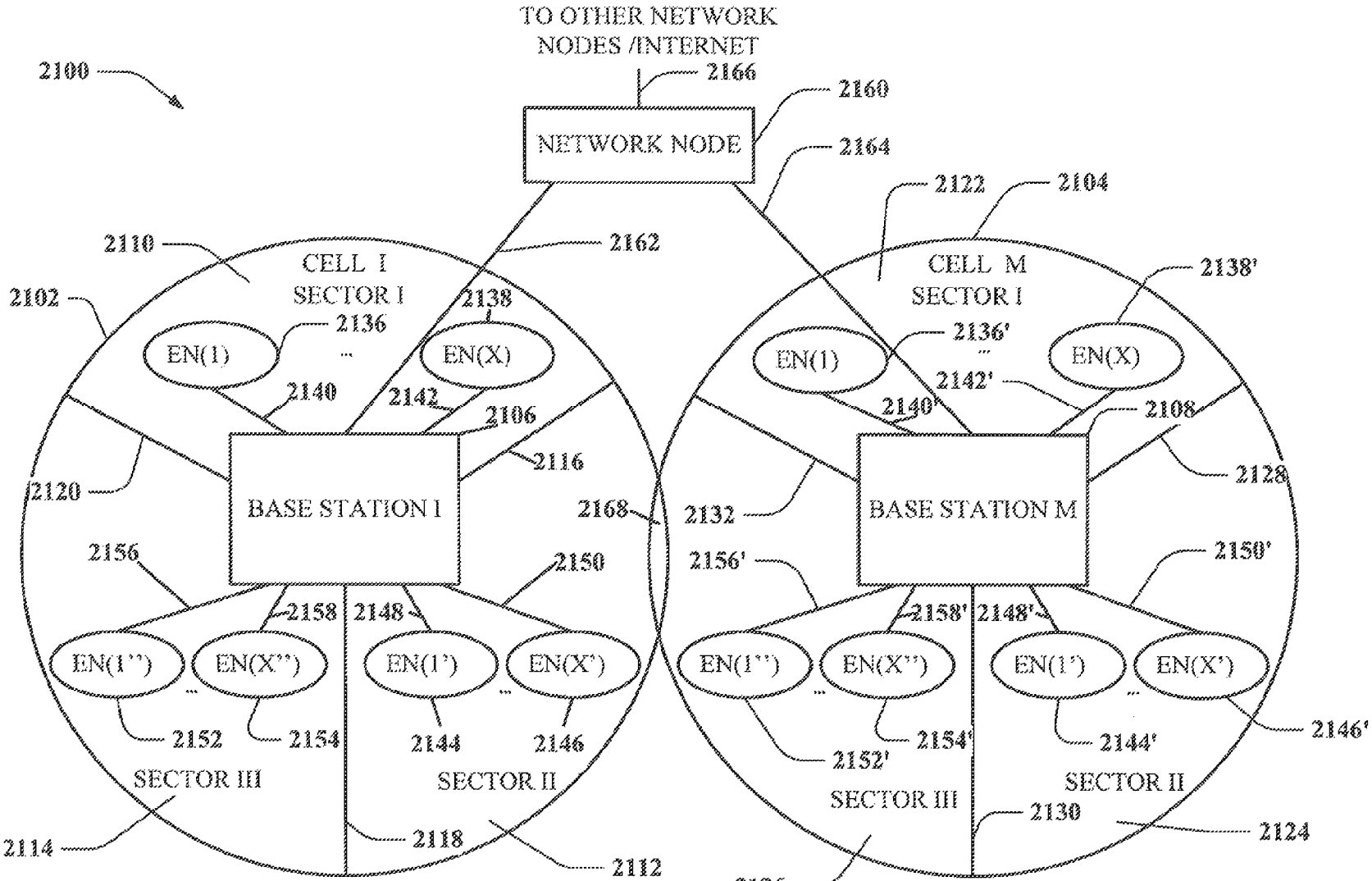
FIG. 21 is an illustration of an example communication system implemented in accordance with various aspects including multiple cells.

FIG. 21 depicts an example communication system 2100 implemented in accordance with various aspects including multiple cells: cell I 2102, cell M 2104. Note that neighboring cells 2102, 2104 overlap slightly, as indicated by cell boundary region 2168, thereby creating potential for signal interference between signals transmitted by base stations in neighboring cells. Each cell 2102, 2104 of system 2100 includes three sectors. Cells which have not be subdivided into multiple sectors (N=1), cells with two sectors (N=2) and cells with more than 3 sectors (N>3) are also possible in accordance with various aspects. Cell 2102 includes a first sector, sector I 2110, a second sector, sector II 2112, and a third sector, sector III 2114. Each sector 2110, 2112, 2114 has two sector boundary regions; each boundary region is shared between two adjacent sectors.

Sector boundary regions provide potential for signal interference between signals transmitted by base stations in neighboring sectors. Line 2116 represents a sector boundary region between sector I 2110 and sector II 2112; line 2118 represents a sector boundary region between sector II 2112 and sector III 2114; line 2120 represents a sector boundary region between sector III 2114 and sector 1 2110. Similarly, cell M 2104 includes a first sector, sector I 2122, a second sector, sector II 2124, and a third sector, sector III 2126. Line 2128 represents a sector boundary region between sector I 2122 and sector II 2124; line 2130 represents a sector boundary region between sector II 2124 and sector III 2126; line 2132 represents a boundary region between sector III 2126 and sector I 2122. Cell I 2102 includes a base station (BS), base station I 2106, and a plurality of end nodes (ENs) (e.g., wireless terminals) in each sector 2110, 2112, 2114. Sector I 2110 includes EN(1) 2136 and EN(X) 2138 coupled to BS 2106 via wireless links 2140, 2142, respectively; sector II 2112 includes EN(1') 2144 and EN(X') 2146 coupled to BS 2106 via wireless links 2148, 2150, respectively; sector III 2114 includes EN(1") 2152 and EN(X") 2154 coupled to BS 2106 via wireless links 2156, 2158, respectively. Similarly, cell M 2104 includes base station M 2108, and a plurality of end nodes (ENs) in each sector 2122, 2124, 2126. Sector I 2122 includes EN(1) 2136' and EN(X) 2138' coupled to BS M 2108 via wireless links 2140', 2142', respectively; sector II 2124 includes EN(1') 2144' and EN(X') 2146' coupled to BS M 2108 via wireless links 2148', 2150', respectively; sector 3 2126 includes EN(1") 2152' and EN(X") 2154' coupled to BS 2108 via wireless links 2156', 2158', respectively.

System 2100 also includes a network node 2160 which is coupled to BS I 2106 and BS M 2108 via network links 2162, 2164, respectively. Network node 2160 is also coupled to other network nodes, e.g., other base stations, AAA server nodes, intermediate nodes, routers, etc. and the Internet via network link 2166. Network links 2162, 2164, 2166 may be, e.g., fiber optic cables. Each end node, e.g., EN(1) 2136 may be a wireless terminal including a transmitter as well as a receiver. The wireless terminals, e.g., EN(1) 2136 may move through system 2100 and may communicate via wireless links with the base station in the cell in which the EN is currently located. The wireless terminals, (WTs), e.g., EN(1) 2136, may communicate with peer nodes, e.g., other WTs in system 2100 or outside system 2100 via a base station, e.g., BS 2106, and/or network node 2160. WTs, e.g., EN(1) 2136 may be mobile communications devices such as cell phones, personal data assistants with wireless modems, etc. Respective base stations perform tone subset allocation using a different method for the strip-symbol periods, from the method employed for allocating tones and determining tone hopping in the rest symbol periods, e.g., non strip-symbol periods. The wireless terminals use the tone subset allocation method along with information received from the base station, e.g., base station slope ID, sector ID information, to determine tones that they can employ to receive data and information at specific strip-symbol periods. The tone subset allocation sequence is constructed, in accordance with various aspects to spread inter-sector and inter-cell interference across respective tones.

Figure 22:
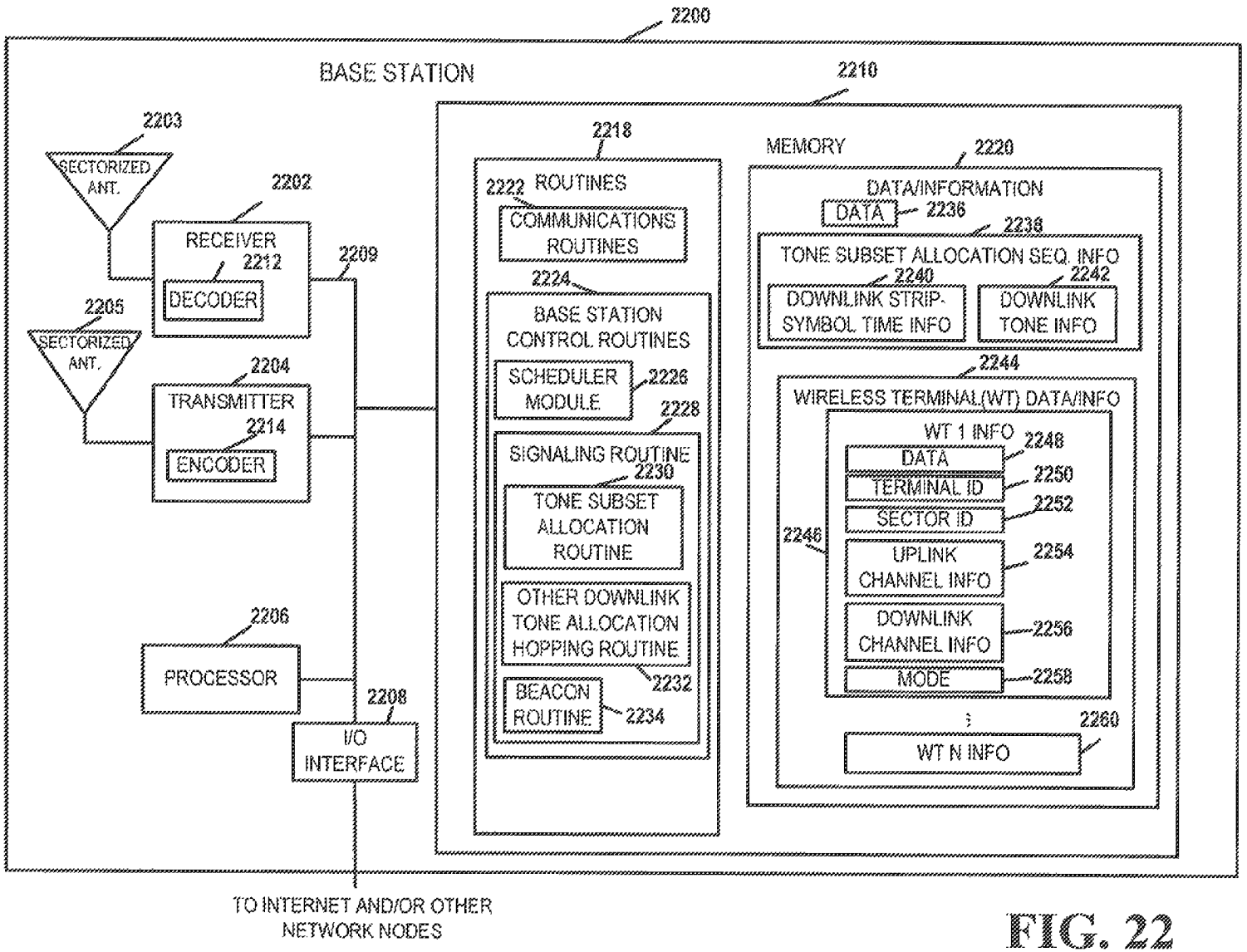
FIG. 22 is an illustration of an example base station in accordance with various aspects.

FIG. 22 illustrates an example base station 2200 in accordance with various aspects. Base station 2200 implements tone subset allocation sequences, with different tone subset allocation sequences generated for respective different sector types of the cell. Base station 2200 may be used as any one of base stations 2106, 2108 of the system 2100 of FIG. 21. The base station 2200 includes a receiver 2202, a transmitter 2204, a processor 2206, e.g., CPU, an input/output interface 2208 and memory 2210 coupled together by a bus 2209 over which various elements 2202, 2204, 2206, 2208, and 2210 may interchange data and information.

Sectorized antenna 2203 coupled to receiver 2202 is used for receiving data and other signals, e.g., channel reports, from wireless terminals transmissions from each sector within the base station's cell. Sectorized antenna 2205 coupled to transmitter 2204 is used for transmitting data and other signals, e.g., control signals, pilot signal, beacon signals, etc. to wireless terminals 2300 (see FIG. 23) within each sector of the base station's cell. In various aspects, base station 2200 may employ multiple receivers 2202 and multiple transmitters 2204, e.g., an individual receiver 2202 for each sector and an individual transmitter 2204 for each sector. Processor 2206 may be, e.g., a general purpose central processing unit (CPU). Processor 2206 controls operation of base station 2200 under direction of one or more routines 2218 stored in memory 2210 and implements the methods. I/O interface 2208 provides a connection to other network nodes, coupling the BS 2200 to other base stations, access routers, AAA server nodes, etc., other networks, and the Internet. Memory 2210 includes routines 2218 and data/information 2220.

Data/information 2220 includes data 2236, tone subset allocation sequence information 2238 including downlink strip-symbol time information 2240 and downlink tone information 2242, and wireless terminal (WT) data/info 2244 including a plurality of sets of WT information: WT 1 info 2246 and WT N info 2260. Each set of WT info, e.g., WT 1 info 2246 includes data 2248, terminal ID 2250, sector ID 2252, uplink channel information 2254, downlink channel information 2256, and mode information 2258.

Routines 2218 include communications routines 2222 and base station control routines 2224. Base station control routines 2224 includes a scheduler module 2226 and signaling routines 2228 including a tone subset allocation routine 2230 for strip-symbol periods, other downlink tone allocation hopping routine 2232 for the rest of symbol periods, e.g., non strip-symbol periods, and a beacon routine 2234.

Data 2236 includes data to be transmitted that will be sent to encoder 2214 of transmitter 2204 for encoding prior to transmission to WTs, and received data from WTs that has been processed through decoder 2212 of receiver 2202 following reception. Downlink strip-symbol time information 2240 includes the frame synchronization structure information, such as the superslot, beaconslot, and ultraslot structure information and information specifying whether a given symbol period is a strip-symbol period, and if so, the index of the strip-symbol period and whether the strip-symbol is a resetting point to truncate the tone subset allocation sequence used by the base station. Downlink tone information 2242 includes information including a carrier frequency assigned to the base station 2200, the number and frequency of tones, and the set of tone subsets to be allocated to the strip-symbol periods, and other cell and sector specific values such as slope, slope index and sector type.

Data 2248 may include data that WT1 2300 has received from a peer node, data that WT 1 2300 desires to be transmitted to a peer node, and downlink channel quality report feedback information. Terminal ID 2250 is a base station 2200 assigned ID that identifies WT 1 2300. Sector ID 2252 includes information identifying the sector in which WT1 2300 is operating. Sector ID 2252 can be used, for example, to determine the sector type. Uplink channel information 2254 includes information identifying channel segments that have been allocated by scheduler 2226 for WT1 2300 to use, e.g., uplink traffic channel segments for data, dedicated uplink control channels for requests, power control, timing control, etc. Each uplink channel assigned to WT 1 2300 includes one or more logical tones, each logical tone following an uplink hopping sequence. Downlink channel information 2256 includes information identifying channel segments that have been allocated by scheduler 2226 to carry data and/or information to WT1 2300, e.g., downlink traffic channel segments for user data. Each downlink channel assigned to WT1 2300 includes one or more logical tones, each following a downlink hopping sequence. Mode information 2258 includes information identifying the state of operation of WT1 2300, e.g. sleep, hold, on.

Communications routines 2222 control the base station 2200 to perform various communications operations and implement various communications protocols. Base station control routines 2224 are used to control the base station 2200 to perform basic base station functional tasks, e.g., signal generation and reception, scheduling, and to implement the steps of the method of some aspects including transmitting signals to wireless terminals using the tone subset allocation sequences during the strip-symbol periods.

Signaling routine 2228 controls the operation of receiver 2202 with its decoder 2212 and transmitter 2204 with its encoder 2214. The signaling routine 2228 is responsible for controlling the generation of transmitted data 2236 and control information. Tone subset allocation routine 2230 constructs the tone subset to be used in a strip-symbol period using the method of the aspect and using data/information 2220 including downlink strip-symbol time info 2240 and sector ID 2252. The downlink tone subset allocation sequences will be different for each sector type in a cell and different for adjacent cells. The WTs 2300 receive the signals in the strip-symbol periods in accordance with the downlink tone subset allocation sequences; the base station 2200 uses the same downlink tone subset allocation sequences in order to generate the transmitted signals. Other downlink tone allocation hopping routine 2232 constructs downlink tone hopping sequences, using information including downlink tone information 2242, and downlink channel information 2256, for the symbol periods other than the strip-symbol periods. The downlink data tone hopping sequences are synchronized across the sectors of a cell. Beacon routine 2234 controls the transmission of a beacon signal, e.g., a signal of relatively high power signal concentrated on one or a few tones, which may be used for synchronization purposes, e.g., to synchronize the frame timing structure of the downlink signal and therefore the tone subset allocation sequence with respect to an ultra-slot boundary.

Figure 23:
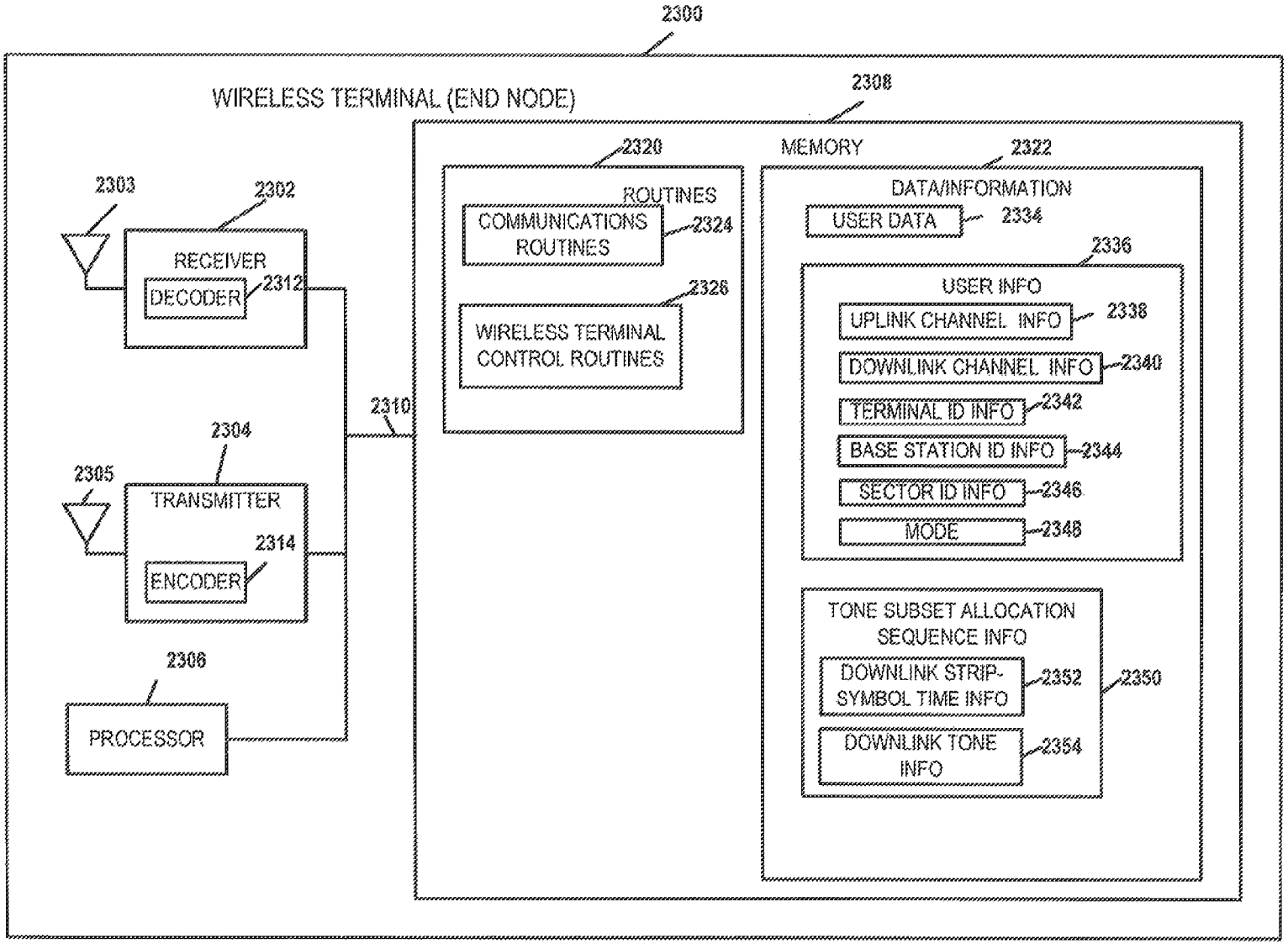
FIG. 23 is an illustration of an example wireless terminal (e.g., mobile device, end node, . . . ) implemented in accordance with various aspects described herein.

FIG. 23 illustrates an example wireless terminal (e.g., end node, mobile device, . . . ) 2300 which can be used as any one of the wireless terminals (e.g., end nodes, mobile devices, . . . ), e.g., EN(1) 2136, of the system 2100 shown in FIG. 21. Wireless terminal 2300 implements the tone subset allocation sequences. Wireless terminal 2300 includes a receiver 2302 including a decoder 2312, a transmitter 2304 including an encoder 2314, a processor 2306, and memory 2308 which are coupled together by a bus 2310 over which the various elements 2302, 2304, 2306, 2308 can interchange data and information. Antenna(s) 2303 used for receiving signals from a base station 2200 (and/or a disparate wireless terminal) are coupled to receiver 2302. Antenna(s) 2305 used for transmitting signals, e.g., to base station 2200 (and/or a disparate wireless terminal) are coupled to transmitter 2304. It is to be appreciated that antenna(s) 2303 and antenna(s) 2305 can be included in a MIMO expandable antenna structure as described herein.

The processor 2306 (e.g., a CPU) controls operation of wireless terminal 2300 and implements methods by executing routines 2320 and using data/information 2322 in memory 2308.

Data/information 2322 includes user data 2334, user information 2336, and tone subset allocation sequence information 2350. User data 2334 may include data, intended for a peer node, which will be routed to encoder 2314 for encoding prior to transmission by transmitter 2304 to base station 2200, and data received from the base station 2200 which has been processed by the decoder 2312 in receiver 2302. User information 2336 includes uplink channel information 2338, downlink channel information 2340, terminal ID information 2342, base station ID information 2344, sector ID information 2346, and mode information 2348. Uplink channel information 2338 includes information identifying uplink channels segments that have been assigned by base station 2200 for wireless terminal 2300 to use when transmitting to the base station 2200. Uplink channels may include uplink traffic channels, dedicated uplink control channels, e.g., request channels, power control channels and timing control channels. Each uplink channel includes one or more logic tones, each logical tone following an uplink tone hopping sequence. The uplink hopping sequences are different between each sector type of a cell and between adjacent cells. Downlink channel information 2340 includes information identifying downlink channel segments that have been assigned by base station 2200 to WT 2300 for use when BS 2200 is transmitting data/information to WT 2300. Downlink channels may include downlink traffic channels and assignment channels, each downlink channel including one or more logical tone, each logical tone following a downlink hopping sequence, which is synchronized between each sector of the cell.

User info 2336 also includes terminal ID information 2342, which is a base station 2200 assigned identification, base station ID information 2344 which identifies the specific base station 2200 that WT has established communications with, and sector ID info 2346 which identifies the specific sector of the cell where WT 2300 is presently located. Base station ID 2344 provides a cell slope value and sector ID info 2346 provides a sector index type; the cell slope value and sector index type may be used to derive tone hopping sequences. Mode information 2348 also included in user info 2336 identifies whether the WT 2300 is in sleep mode, hold mode, or on mode.

Tone subset allocation sequence information 2350 includes downlink strip-symbol time information 2352 and downlink tone information 2354. Downlink strip-symbol time information 2352 include the frame synchronization structure information, such as the superslot, beaconslot, and ultraslot structure information and information specifying whether a given symbol period is a strip-symbol period, and if so, the index of the strip-symbol period and whether the strip-symbol is a resetting point to truncate the tone subset allocation sequence used by the base station. Downlink tone info 2354 includes information including a carrier frequency assigned to the base station 2200, the number and frequency of tones, and the set of tone subsets to be allocated to the strip-symbol periods, and other cell and sector specific values such as slope, slope index and sector type.

Routines 2320 include communications routines 2324 and wireless terminal control routines 2326. Communications routines 2324 control the various communications protocols used by WT 2300. By way of example, communications routines 2324 may enable receiving a broadcast signal (e.g., from base station 2200). Wireless terminal control routines 2326 control basic wireless terminal 2300 functionality including the control of the receiver 2302 and transmitter 2304.

Figure 24:
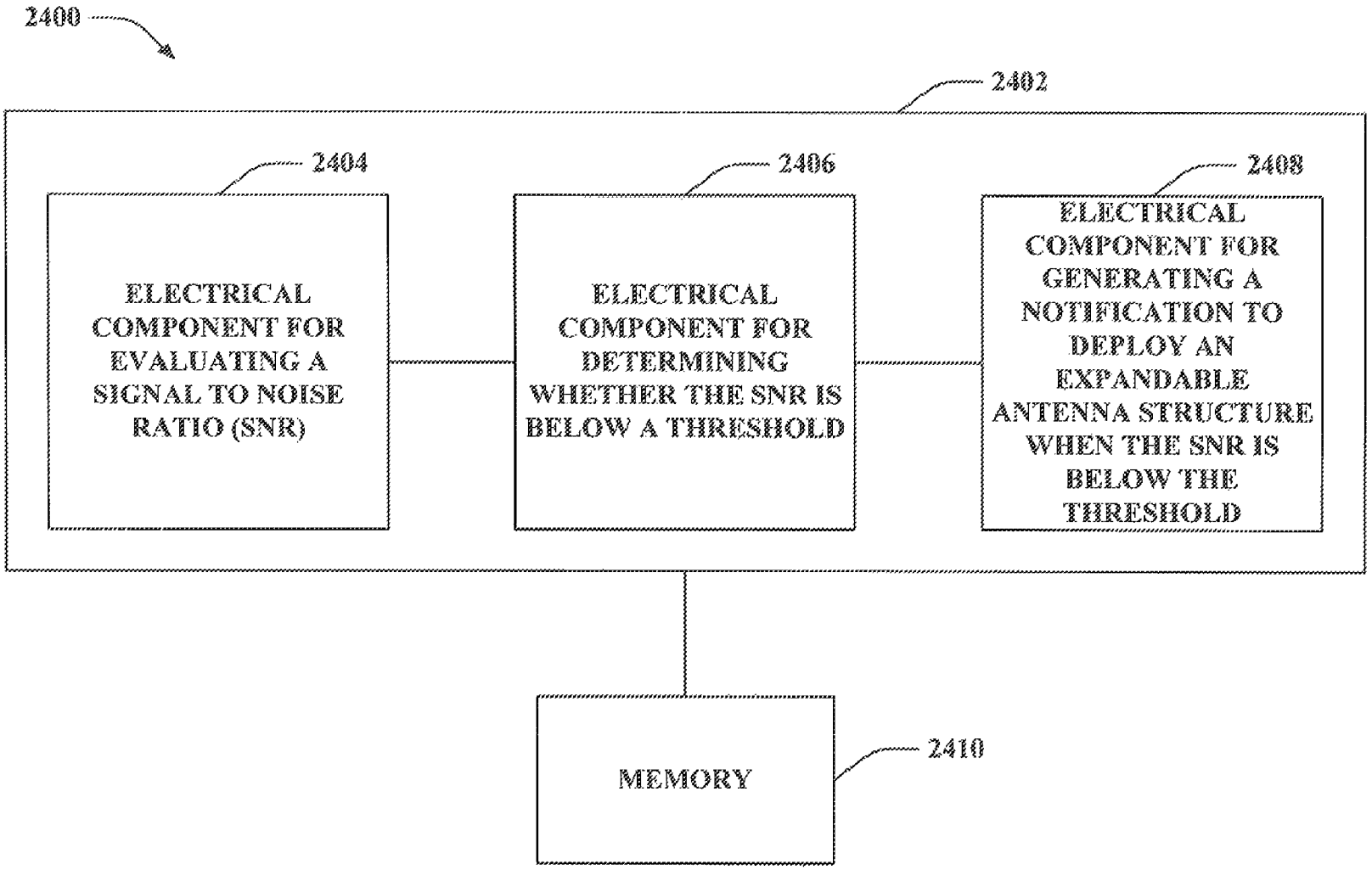
FIG. 24 is an illustration of a system that enables monitoring signal strength in connection with an expandable antenna structure.

With reference to FIG. 24, illustrated is a system 2400 that enables monitoring signal strength in connection with an expandable antenna structure. For example, system 2400 may reside at least partially within a mobile device. It is to be appreciated that system 2400 is represented as including functional blocks, which may be functional blocks that represent functions implemented by a processor, software, or combination thereof (e.g., firmware). System 2400 includes a logical grouping 2402 of electrical components that can act in conjunction. For instance, logical grouping 2402 may include an electrical component for evaluating a signal to noise ratio (SNR) 2404. Pursuant to an illustration, the SNR can be determined for communications effectuated with an expandable antenna structure. Further, logical grouping 2402 can comprise an electrical component for determining whether the SNR is below a threshold 2406. Moreover, logical grouping 2402 can include an electrical component for generating a notification to deploy an expandable antenna structure when the SNR is below the threshold 2408. By way of illustration, the expandable antenna structure can additionally or alternatively be deployed automatically when the SNR is below the threshold. Additionally, system 2400 may include a memory 2410 that retains instructions for executing functions associated with electrical components 2404, 2406, and 2408. While shown as being external to memory 2410, it is to be understood that one or more of electrical components 2404, 2406, and 2408 may exist within memory 2410.

It is to be understood that the embodiments described herein may be implemented in hardware, software, firmware, middleware, microcode, or any combination thereof. For a hardware implementation, the processing units may be implemented within one or more application specific integrated circuits (ASICs), digital signal processors (DSPs), digital signal processing devices (DSPDs), programmable logic devices (PLDs), field programmable gate arrays (FPGAs), processors, controllers, micro-controllers, microprocessors, other electronic units designed to perform the functions described herein, or a combination thereof.

When the embodiments are implemented in software, firmware, middleware or microcode, program code or code segments, they may be stored in a machine-readable medium, such as a storage component. A code segment may represent a procedure, a function, a subprogram, a program, a routine, a subroutine, a module, a software package, a class, or any combination of instructions, data structures, or program statements. A code segment may be coupled to another code segment or a hardware circuit by passing and/or receiving information, data, arguments, parameters, or memory contents. Information, arguments, parameters, data, etc. may be passed, forwarded, or transmitted using any suitable means including memory sharing, message passing, token passing, network transmission, etc.

For a software implementation, the techniques described herein may be implemented with modules (e.g., procedures, functions, and so on) that perform the functions described herein. The software codes may be stored in memory units and executed by processors. The memory unit may be implemented within the processor or external to the processor, in which case it can be communicatively coupled to the processor via various means as is known in the art.

What has been described above includes examples of one or more embodiments. It is, of course, not possible to describe every conceivable combination of components or methodologies for purposes of describing the aforementioned embodiments, but one of ordinary skill in the art may recognize that many further combinations and permutations of various embodiments are possible. Accordingly, the described embodiments are intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A method for employing a multiple-input, multiple-output antenna in a wireless terminal, comprising:

releasing a self-expandable multiple-input, multiple-output antenna structure to expand to a deployed position;

receiving a radio frequency signal via one or more antennas of the self-expandable multiple-input, multiple-output antenna structure; and coupling the received radio frequency signal to a transceiver unit in the wireless terminal.

2. The method of claim 1, wherein the self-expandable multiple-input, multiple-output antenna structure fans out circularly to the deployed position.

3. The method of claim 2, wherein the deployed position fans the self-expandable multiple-input, multiple-output antenna structure 90° from a collapsed position.

4. The method of claim 2, wherein the deployed position fans the self-expandable multiple-input, multiple-output antenna structure 180° from a collapsed position.

5. The method of claim 2, wherein the deployed position fans the self-expandable multiple-input, multiple-output antenna structure 360° from a collapsed position.

6. The method of claim 1, further comprising:

coupling a radio frequency signal for transmission from the transceiver unit in the wireless terminal to the self-expandable multiple-input, multiple-output antenna structure; and transmitting a radio frequency signal via the one or more antennas of the self-expandable multiple-input, multiple-output antenna structure.

7. The method of claim 6, further comprising transmitting a radio frequency signal via the one or more antennas on any of a plurality of frequencies.

8. The method of claim 1, wherein said releasing the self-expandable multiple-input, multiple-output antenna structure comprises deploying each of the multiple-input, multiple-output antennas at a first angle between adjacent antennas to provide polarization diversity among the adjacent antennas.

9. The method of claim 1, further comprising receiving a radio frequency signal via the one or more antennas on any of a plurality of frequencies.

10. The method of claim 1, further comprising collapsing the multiple-input, multiple-output antenna structure.

11. The method of claim 1, further comprising receiving an electronic signal, wherein the releasing a self-expandable multiple-input, multiple-output antenna structure to expand to a deployed position is accomplished in response to the received electronic signal.

12. A self-expandable multiple-input, multiple-output antenna system that enables multiple-input, multiple-out communications in a wireless terminal, comprising:

means for releasing the self-expandable multiple-input, multiple-output antenna system to a deployed position, wherein the self-expandable multiple-input, multiple-output antenna system includes one or more antenna elements;

means for receiving radio frequency signals via the one or more antenna elements; and means for coupling the received radio frequency signal to a transceiver unit in the wireless terminal.

13. The system of claim 12, further comprising means for collapsing the antenna structure.

14. The self-expandable multiple-input, multiple-output antenna system of claim 12, further comprising means for fanning the self-expandable multiple-input, multiple-output antenna structure circularly to the deployed position.

15. The self-expandable multiple-input, multiple-output antenna system of claim 14, wherein the deployed position fans the self-expandable antenna structure 90° from a collapsed position.

16. The self-expandable multiple-input, multiple-output antenna system of claim 14, wherein the deployed position fans the self-expandable antenna structure 180° from a collapsed position.

17. The self-expandable multiple-input, multiple-output antenna system of claim 14, wherein the deployed position fans the self-expandable antenna structure 360° from a collapsed position.

18. The self-expandable multiple-input, multiple-output antenna system of claim 12, further comprising:

means for coupling a radio frequency signal for transmission from the transceiver unit in the wireless terminal to the self-expandable multiple-input, multiple-output antenna structure; and means for transmitting the radio frequency signal via the one or more antennas of the self-expandable multiple-input, multiple-output antenna structure.

19. The self-expandable multiple-input, multiple-output antenna system of claim 12, wherein said means for releasing the self-expandable multiple-input, multiple-output antenna structure comprises means for deploying each of the multiple-input, multiple-output antennas at a first angle between adjacent antennas to provide polarization diversity among the adjacent antennas.

20. The self-expandable multiple-input, multiple-output antenna system of claim 12, further comprising means for receiving a radio frequency signal via the one or more antennas on any of a plurality of frequencies.

21. The self-expandable multiple-input, multiple-output antenna system of claim 12, further comprising means for transmitting a radio frequency signal via the one or more antennas of the self-expandable antenna structure.

22. The self-expandable multiple-input, multiple-output antenna system of claim 21, wherein said means for transmitting a radio frequency signal via the one or more antennas comprises means for transmitting a radio frequency signal on any of a plurality of frequencies.

23. The self-expandable multiple-input, multiple-output antenna system of claim 12, further comprising means for receiving an electronic signal, wherein the means for releasing a self-expandable antenna structure to expand to a deployed position operates in response to the received electronic signal.

24. A non-transitory computer-readable medium having stored thereon computer-executable software instructions configured to cause a wireless terminal processor to perform steps comprising:

releasing a self-expandable multiple-input, multiple-output antenna structure on the wireless terminal to expand to a deployed position;

receiving a radio frequency signal via one or more antennas of the self-expandable antenna structure; and for coupling the received radio frequency signal to a transceiver unit in the wireless terminal.

25. The non-transitory computer-readable medium of claim 24, wherein the non-transitory computer-readable medium has computer-executable software instructions configured to cause the wireless terminal processor to perform further steps comprising:

coupling a radio frequency signal for transmission from the transceiver unit in the wireless terminal to the self-expandable antenna structure; and transmitting a radio frequency signal via the one or more antennas of the self-expandable antenna structure.

26. The non-transitory computer-readable medium of claim 25, wherein the non-transitory computer-readable medium has computer-executable software instructions configured to cause the wireless terminal processor to perform further steps comprising:

transmitting a radio frequency signal via the one or more antennas on any of a plurality of frequencies.

27. The non-transitory computer-readable medium of claim 25, wherein the non-transitory computer-readable medium has computer-executable software instructions configured to cause the wireless terminal processor to perform further steps comprising:

selecting which of the one or more antennas is utilized to transmit radio frequency signals.

28. The non-transitory computer-readable medium of claim 24, wherein the non-transitory computer-readable medium has computer-executable software instructions configured to cause the wireless terminal processor to perform further steps comprising:

receiving a radio frequency signal via the one or more antennas on any of a plurality of frequencies.

29. The non-transitory computer-readable medium of claim 24, wherein the non-transitory computer-readable medium has computer-executable software instructions configured to cause the wireless terminal processor to perform further steps comprising:

collapsing the antenna structure.

30. The non-transitory computer-readable medium of claim 24, wherein the non-transitory computer-readable medium has computer-executable software instructions configured to cause the wireless terminal processor to perform further steps comprising:

receiving an electronic signal, wherein the at least one instruction to release the self-expandable antenna structure to expand to a deployed position is in response to the received electronic signal.

31. The non-transitory computer-readable medium of claim 24, wherein the non-transitory computer-readable medium has computer-executable software instructions configured to cause the wireless terminal processor to perform further steps comprising:

selecting which of the one or more antennas is utilized to receive radio frequency signals.

32. A wireless terminal comprising:

a self-expandable multiple-input, multiple-out antenna system comprising:

a flexible circuit operable in and in between a collapsed and deployed position; and a plurality of antenna elements printed on one or more surfaces of the flexible circuit.

33. The wireless terminal of claim 32, wherein the plurality of antenna elements are offset on a surface plane with respect to one another.

34. The wireless terminal of claim 32, wherein the self-expandable multiple-input, multiple-out antenna further comprises a first angle between adjacent printed surfaces to provide polarization diversity among printed antenna elements.

35. The wireless terminal of claim 34, wherein the first angle is at least 30 degrees.

36. The wireless terminal of claim 32, wherein the self-expandable multiple-input, multiple-out antenna further comprises a first angle between adjacent printed surfaces to provide spatial diversity among printed antenna elements.

37. The wireless terminal of claim 32, wherein the plurality of antenna elements are operable on a plurality of frequencies.

38. The wireless terminal of claim 32, wherein the flexible circuit transitions between the collapsed and expanded positions in response to a signal.

39. The wireless terminal of claim 32, wherein the flexible circuit circularly unfolds into the deployed position.

40. The wireless terminal of claim 32, wherein the flexible circuit vertically unfolds into the expanded position.

41. The wireless terminal of claim 32, wherein the deployed position fans the self-expandable antenna structure 90° from a collapsed position.

42. The wireless terminal of claim 32, wherein the deployed position fans the self-expandable antenna structure 180° from a collapsed position.

43. The wireless terminal of claim 32, wherein the deployed position fans the self-expandable antenna structure 360° from a collapsed position.

44. The wireless terminal of claim 32, wherein the self-expandable multiple-input, multiple-out antenna system is housed on a removable PC card.

45. The wireless terminal of claim 32, wherein the self-expandable multiple-input, multiple-out antenna system is configured to retract into the wireless terminal when in a collapsed position.

46. The wireless terminal of claim 32, wherein the self-expandable multiple-input, multiple-out antenna system is linearly extendable.

* * * * *